US005281951A

United States Patent [19]

Okayama

[11] Patent Number: 5,281,951

[45] Date of Patent: Jan. 25, 1994

[54] FIRE ALARM SYSTEM AND METHOD EMPLOYING MULTI-LAYER NET PROCESSING STRUCTURE OF DETECTION VALUE WEIGHT COEFFICIENTS

[75] Inventor: Yoshiaki Okayama, Tokyo, Japan

[73] Assignee: Nohmi Bosai Kabushiki Kaisha, Tokyo, Japan

[21] Appl. No.: 490,582

[22] PCT Filed: Oct. 12, 1989

[86] PCT No.: PCT/JP89/01049

§ 371 Date: May 14, 1990

§ 102(e) Date: May 14, 1990

[87] PCT Pub. No.: WO90/04241

PCT Pub. Date: Apr. 19, 1990

[30] Foreign Application Priority Data

Oct. 13, 1988 [JP] Japan ..... 63-255840
Nov. 9, 1988 [JP] Japan ..... 63-281167

[51] Int. Cl.[5] ..... G08B 29/00

[52] U.S. Cl. ..... 340/511; 340/514; 340/588; 340/589

[58] Field of Search ..... 340/511, 510, 514, 588, 340/589, 870.14

[56] References Cited

U.S. PATENT DOCUMENTS 3,980,997 9/1976 Berns ..... 250/552
4,831,361 5/1989 Kimura ..... 340/510
4,871,999 10/1989 Ishii ..... 340/628
4,884,222 11/1989 Nagashima ..... 340/589

*Primary Examiner*—Hezron E. Williams
*Assistant Examiner*—Christine K. Oda
*Attorney, Agent, or Firm*—Wenderoth, Lind & Ponack

[57] ABSTRACT

A fire monitoring system detects a plurality of types of detection information using a plurality of fire phenomenon detectors for detecting physical quantities caused by fire phenomena or using a plurality of detectors each including at least one fire phenomenon detector and at least one environment detector provided in association with the fire phenomenon detector. The plurality of types of detection information undergo consolidated signal processing for obtaining one or more types of fire information for realizing fire monitoring. The fire monitoring system includes a table for storing a specific set of values one for each type of detection information and a corresponding set of values for each type of fire information to be obtained when the specific set of values of detection information is supplied, and a signal processing net having a multilayer structure responsive to the input of respective values for the types of detection information to thereby impart corresponding weights to each value of the input detection information in accordance with the degree of contribution thereof to each value of fire information and to arithmetically determine each value of fire information on the basis of the weighted detection information values. In a learning mode, the weights are adjusted that a value for each type of fire information determined arithmetically when the specific set of values of detection information placed in the table is supplied to the signal processing net approximates the value for each type of fire information contained in the table.

11 Claims, 22 Drawing Sheets

FIG. 2

DEFINITION TABLE (RAM 12)

| PATTERN No. | SMOKE SENSOR IN1 | TEMP. SENSOR ΔT IN2 | GAS SENSOR IN3 | FIRE PROB T1 | DANGER DEGREE T2 | SMOLDER PROB T3 |
|---|---|---|---|---|---|---|
| 1 | 0.1 | 0.0 | 1 | 0.7 | 0.6 | 0.9 |
| 2 | 0.3 | 0.5 | 1 | 0.9 | 0.9 | 0.1 |
| 3 | 0.1 | 0 | 0.2 | 0.3 | 0.2 | 0.4 |
| 4 | 0.5 | 0.1 | 0.8 | 0.8 | 0.8 | 0.7 |
| 5 | 0 | 0.3 | 0.1 | 0.1 | 0.1 | 0.1 |
| 6 | 0 | 0 | 1 | 0.4 | 0.7 | 0.3 |
| 7 | 0 | 1 | 0 | 0.2 | 0.3 | 0.05 |
| 8 | 0.3 | 0.2 | 0.5 | 0.7 | 0.6 | 0.3 |
| 9 | 0.6 | 0.8 | 0.8 | 0.95 | 0.95 | 0.05 |
| 10 | 0.2 | 0 | 0.3 | 0.6 | 0.4 | 0.75 |
| 11 | 0.1 | 0 | 0.1 | 0.1 | 0.05 | 0.10 |
| 12 | 0.4 | 0.2 | 0 | 0.7 | 0.65 | 0.20 |

FIG. 2A

DEFINITION TABLE (RAM 12)

| | INPUT | | | OUTPUT | |
|---|---|---|---|---|---|
| PATTERN No. | SENSOR LEVEL IN1' | DUR TIME IN2' | VENT ON/OFF IN3' | FIRE PROB T1' | DANGER DEGREE T2' |
| 1 | 0.05 | 1 | 0 | 0.05 | 0.05 |
| 2 | 0.05 | 0.1 | 0 | 0.05 | 0.05 |
| 3 | 0.2 | 0.3 | 0 | 0.3 | 0.2 |
| 4 | 0.4 | 0.1 | 0 | 0.3 | 0.2 |
| 5 | 0.6 | 0.6 | 0 | 0.8 | 0.9 |
| 6 | 0.5 | 0.1 | 0 | 0.35 | 0.2 |
| 7 | 0.2 | 1.0 | 0 | 0.6 | 0.6 |
| 8 | 0.05 | 1 | 1 | 0.05 | 0.05 |
| 9 | 0.2 | 0.3 | 1 | 0.6 | 0.7 |
| 10 | 0.3 | 0.6 | 1 | 0.8 | 0.85 |
| 11 | 0.5 | 0.1 | 1 | 0.2 | 0.2 |
| 12 | 0.4 | 0.3 | 1 | 0.7 | 0.8 |
| 13 | 0.8 | 0 | 1 | 0.1 | 0.2 |
| 14 | 0.8 | 0 | 0 | 0.05 | 0.1 |

FIG. 5B

SENSOR LEVEL / DURATION TIME TABLE (RAM 14)

| SENSOR LEVEL | DURATION TIME |
|---|---|
| ≥ 10 | 25 (sec.) |
| ≥ 11 | 20 (sec.) |
| ≥ 12 | 20 (sec.) |
| ≥ 13 | 20 (sec.) |
| ≥ 14 | 15 (sec.) |
| ≥ 15 | 0 (sec.) |
| ⋮ | ⋮ |
| ≥ 48 | 0 (sec.) |
| ≥ 49 | 0 (sec.) |
| ≥ 50 | 0 (sec.) |

FIG. 8

| | | | | PATTERN No. |
|---|---|---|---|---|
| IN | .100 | 0.000 | 1.000 | 1 |
| T | .700 | .600 | .900 | |
| OT | .661 | .702 | .802 | |
| IN | .300 | .500 | 1.000 | 2 |
| T | .900 | .900 | .100 | |
| OT | .885 | .899 | .037 | |
| IN | .100 | 0.000 | .200 | 3 |
| T | .300 | .200 | .400 | |
| OT | .254 | .187 | .289 | |
| IN | .500 | .100 | .800 | 4 |
| T | .800 | .800 | .700 | |
| OT | .829 | .786 | .722 | |
| IN | .000 | .300 | .100 | 5 |
| T | .100 | .100 | .100 | |
| OT | .094 | .098 | 0.000 | |
| IN | .000 | 0.000 | 1.000 | 6 |
| T | .400 | .700 | .300 | |
| OT | .453 | .588 | .376 | |
| IN | .000 | 1.000 | 0.000 | 7 |
| T | .200 | .300 | .050 | |
| OT | .190 | .307 | 0.000 | |
| IN | .300 | .200 | .500 | 8 |
| T | .700 | .600 | .300 | |
| OT | .781 | .701 | .247 | |
| IN | .600 | .800 | .800 | 9 |
| T | .950 | .950 | .050 | |
| OT | .902 | .904 | .073 | |
| IN | .200 | 0.000 | .300 | 10 |
| T | .600 | .400 | .750 | |
| OT | .542 | .431 | .756 | |
| IN | .100 | 0.000 | .100 | 11 |
| T | .100 | .050 | .100 | |
| OT | .189 | .119 | .205 | |
| IN | .400 | .200 | 0.000 | 12 |
| T | .700 | .650 | .200 | |
| OT | .714 | .529 | .260 | |
| | 183 | TOTAL | .073239663639 | $= \sum_{m=1}^{12} \sum_{k=1}^{3} \frac{1}{2} \lvert O_k - T_k \rvert^2$ |

FIG. 8A $\sum_{m=1}^{14} \sum_{k=1}^{2} \frac{1}{2} |O_k - T_k|^2 = 0.00625$ 407 TIMES

| PATTERN No. | | | | |
|---|---|---|---|---|
| 1 | IN | 0.050 | 1.000 | 0.000 |
| | T | 0.050 | 0.050 | |
| | OT | 0.066 | 0.044 | |
| 2 | IN | 0.050 | 0.100 | 0.000 |
| | T | 0.050 | 0.050 | |
| | OT | 0.009 | 0.002 | |
| 3 | IN | 0.200 | 0.300 | 0.000 |
| | T | 0.300 | 0.200 | |
| | OT | 0.308 | 0.192 | |
| 4 | IN | 0.400 | 0.100 | 0.000 |
| | T | 0.300 | 0.200 | |
| | OT | 0.334 | 0.198 | |
| 5 | IN | 0.600 | 0.600 | 0.000 |
| | T | 0.800 | 0.900 | |
| | OT | 0.805 | 0.885 | |
| 6 | IN | 0.500 | 0.100 | 0.000 |
| | T | 0.350 | 0.200 | |
| | OT | 0.301 | 0.215 | |
| 7 | IN | 0.200 | 1.000 | 0.000 |
| | T | 0.600 | 0.600 | |
| | OT | 0.586 | 0.607 | |
| 8 | IN | 0.050 | 1.000 | 1.000 |
| | T | 0.050 | 0.050 | |
| | OT | 0.026 | 0.060 | |
| 9 | IN | 0.200 | 0.300 | 1.000 |
| | T | 0.600 | 0.700 | |
| | OT | 0.608 | 0.688 | |
| 10 | IN | 0.300 | 0.600 | 1.000 |
| | T | 0.800 | 0.850 | |
| | OT | 0.793 | 0.863 | |
| 11 | IN | 0.500 | 0.100 | 1.000 |
| | T | 0.200 | 0.200 | |
| | OT | 0.178 | 0.217 | |
| 12 | IN | 0.400 | 0.300 | 1.000 |
| | T | 0.700 | 0.800 | |
| | OT | 0.715 | 0.789 | |
| 13 | IN | 0.800 | 0.000 | 1.000 |
| | T | 0.100 | 0.200 | |
| | OT | 0.116 | 0.193 | |
| 14 | IN | 0.800 | 0.000 | 0.000 |
| | T | 0.050 | 0.100 | |
| | OT | 0.085 | 0.091 | |

FIG. 9

| W | INPUT LAYERS-INTERMEDIATE LAYERS | V | INTERMEDIATE LAYERS-OUTPUT LAYERS |
|---|---|---|---|
| W11 | -9.93 | V11 | -5.02 |
| W21 | -0.16 | V21 | 2.07 |
| W31 | -1.09 | V31 | -0.38 |
| W12 | 5.85 | V41 | 0.26 |
| W22 | 1.13 | V51 | -3.02 |
| W32 | 4.10 | V12 | -3.68 |
| W13 | 8.95 | V22 | 3.38 |
| W23 | -5.93 | V32 | -1.17 |
| W33 | 0.04 | V42 | -0.38 |
| W14 | 0.43 | V52 | -4.98 |
| W24 | 9.94 | V13 | -7.79 |
| W34 | -0.62 | V23 | 1.99 |
| W15 | -1.32 | V33 | 2.72 |
| W25 | -1.24 | V43 | -5.98 |
| W35 | -0.92 | V53 | 0.87 |

FIG. 9A

| W | INPUT LAYERS-INTERMEDIATE LAYERS | V | INTERMEDIATE LAYERS-OUTPUT LAYERS |
|---|---|---|---|
| $W_{11}$ | -9.4558 | $V_{11}$ | -1.9975 |
| $W_{21}$ | 0.4120 | $V_{21}$ | 2.4294 |
| $W_{31}$ | 5.7557 | $V_{31}$ | -4.9682 |
| $W_{12}$ | 7.9501 | $V_{41}$ | -6.8873 |
| $W_{22}$ | -10.6566 | $V_{51}$ | 1.6413 |
| $W_{32}$ | 5.2501 | $V_{61}$ | -1.4316 |
| $W_{13}$ | 2.4037 | $V_{12}$ | -2.0834 |
| $W_{23}$ | -5.4394 | $V_{22}$ | 1.8211 |
| $W_{33}$ | -0.6532 | $V_{32}$ | -3.5581 |
| $W_{14}$ | -10.7052 | $V_{42}$ | -7.2300 |
| $W_{24}$ | 0.0088 | $V_{52}$ | 2.5806 |
| $W_{34}$ | 0.0665 | $V_{62}$ | -6.8680 |
| $W_{15}$ | -3.4554 | | |
| $W_{25}$ | 11.7541 | | |
| $W_{35}$ | -0.9017 | | |
| $W_{16}$ | -2.5666 | | |
| $W_{26}$ | -1.2078 | | |
| $W_{36}$ | -5.3345 | | |

G = 0.2 (GAS SENSOR OUTPUT)

Z = FIRE PROBABILITY ($OT_1$)

X = SMOKE SENSOR

Y = TEMPERATURE SENSOR

G = 0.2

Z = DANGER DEGREE ($OT_2$)

G = 0.2

Z = SMOLDERING FIRE PROBABILITY (OT3)

FIRE ALARM SYSTEM AND METHOD EMPLOYING MULTI-LAYER NET PROCESSING STRUCTURE OF DETECTION VALUE WEIGHT COEFFICIENTS

TECHNICAL FIELD

The present invention relates to a fire alarm system for monitoring fires on the basis of physical quantities such as heat, smoke, gases or the like inherent to the fire phenomena and more particularly to a fire alarm system for performing the fire monitoring by additionally utilizing information representative of environmental states or conditions, when occasion requires.

BACKGROUND TECHNOLOGY

There have heretofore been numerous proposals concerning methods of making decisions as to the occurrence of a fire by comprehensively judging data which is available from a plurality of similar or different types of fire detectors or a method of making the fire decision by comprehensively judging all the data produced by individual sensor parts of multi-element fire detectors each incorporating a multiplicity of sensor elements for detecting heat, smoke or gases. For example, as a system or equipment embodying the above method, there is known one in which the fire decision is made when a value resulting from integration or multiplication of individual elementary sensor outputs exceeds a predetermined value. According to another known system, the fire decision is validated when a predetermined value is exceeded by substituting output values of individual sensors in a specific function. Additionally, there is known a method in which a table defining relations between inputs and outputs is previously prepared, which table is searched for determining whether any value contained therein coincides with the outputs of the individual sensors, whereon the value for which the coincidence is found is read out from the table to be subsequently checked whether that value exceeds a predetermined value, in dependence on which the fire decision is then made.

The methods enumerated above suffer from the shortcomings mentioned below.

(a) Method based on the integration or multiplication of individual sensor outputs:

Although the principle underlying this method is plain, it is too simple for dealing with fire phenomena and lacks reliability to a disadvantage.

(b) Method using functions:

For monitoring all the fire phenomena inclusive of incipient or smoldering fires to conflagrations, a plurality of functions have to be employed, since a single function is insufficient. In that case, the functions must be exchanged in response to the output of a certain one of the sensors, which means that the finally obtained output becomes discontinuous. Further, because the output of the function can represent no more than one result, a number of functions corresponding to the number of possible results are required such as, for example, the probability of a fire and degree or level of danger. Also, great difficulty will be encountered in quickly obtaining a desired function when definitions of the input and output are to be altered or added to.

(c) Table method:

Since the input values from the individual sensors and the results are defined by employing a ROM or the like, there may arise such problems that when only some of the sensor outputs can fulfill the input conditions, blanks in the definition table have to be interpolated by resorting to a partial pattern matching method, although such interpolation is naturally unnecessary when all the input conditions are met. The interpolation becomes very complicated when the number of sensor inputs is great. Also, the table per se must be defined accurately and elaborately.

SUMMARY OF THE INVENTION

Accordingly, it is an object of the present invention to provide a fire alarm system of a structure suited for monitoring for fires by comprehensively judging a plurality of types of detection information available respectively from a plurality of detecting means.

The detection information may include information on a plurality of physical quantities such as heat, smoke, gases and the like due to the fire phenomena. Further, the detection information may include in addition to the physical quantities such as heat, smoke, gases and the like inherent to the fire phenomena such environmental information which may influence the fire monitoring (e.g. on/off states of ventilation fans, operating state of air conditioning equipment as exemplified by the number of times the ventilation is effected, volumes and types of rooms, on/off states of illumination, types and amounts of combustibles, humidity, and if there are comings and goings of unspecified numbers of people etc.).

For achieving the above object, there is provided according to the present invention a fire alarm system in which values for various types of detection information output respectively from a plurality of detecting means are subjected to signal processing for obtaining values for one or more types of fire information to thereby allow a fire decision to be made on the basis of said fire information values, the fire alarm system comprising:

a table storing a specific set of values one for each type of detection information and a corresponding set of values one for each type of fire information to be obtained when said specific set of values of detection information is supplied;

a signal processing net responsive to the input of respective values for types of detection information to thereby impart corresponding weights to each value of the input detection information in accordance with the degree of contribution thereof to each value of the fire information and arithmetically determine each value of the fire information on the basis of the weighted detection information values; and adjusting means for adjusting those weights such that a value for each type of fire information arithmetically determined when the specific set of values of detection information in the table is supplied to the signal processing net approximates the value for each type of fire information contained in the table.

In this case, the plurality of detecting means can be constituted by a plurality of fire phenomena detecting means for detecting the physical quantities inherent to fire phenomena.

Further, said plurality of detecting means includes at least one fire phenomenon detecting means for detecting the physical quantities inherent to fire phenomena and environment detecting means provided in association with said fire phenomenon detecting means, said detection information including fire detection information output from said fire phenomenon detecting means and environment detection information obtained from said environment detecting means.

First, the adjusting means teaches the contents of the definition table into the signal processing net by adjusting the weight values so that the difference of a fire information value output from the signal processing net from the output value indicated in the definition table can be minimized as much as possible. Once the signal processing net has been formed in this manner, it is capable of outputting the desired output values for all the input values, whereby combinations of the input values which are not defined in the definition table can be dealt with so that the value approximating the desired output value is indicated. Thus, in the definition of the input/output relations, it is not necessary to define all the combinations but only those for each important point.

Further, when there is a need to describe in detail the vicinity of singular points or minimum and maximum points where the output value exhibits a significant change even for only a slight deviation of the input value, the peripheral of such points may be defined in detail with the other portions being defined rather roughly.

In case the relation between the input and the output is to be altered, there may be conceived two cases, i.e. definition of the different outputs from those defined for the inputs heretofore and new definition for the region not defined previously. In such a case, alteration of the definition can be easily effected by running the adjusting means (net structure generating program). Thus, by changing the definitions, it becomes possible to make correct and accurate fire decisions, danger decisions and others.

In an exemplary embodiment, it is preferred to provide a storage area for storing the adjusted individual weights. In this case, the abovementioned signal processing net may weight each individual detection information value with the corresponding value read out from the storage area mentioned above, and perform the abovementioned arithmetic operation by using this weighted detection information value.

Further, it is preferred to carry out the arithmetic operation for determining the fire information value in a hierarchical manner such that instead of arithmetically determining the fire information value straightforwardly from the input detection information values, the signal processing net once determines arithmetically intermediate information values from the detection information values and then determines the fire information values from the intermediate information values. The hierarchy may be realized with a plurality of levels or layers, wherein the number of the intermediate information values or units to be arithmetically determined at each of the intermediate hierarchical layers may be set arbitrarily. Supposing, for example, that the hierarchy is to be implemented in two stages of an input-to-intermediate section and an intermediate-to-output section, a first weighting is performed on each of the input information or detection information values to thereby determine arithmetically each of the intermediate information values, whereupon a second weighting is performed on each of the intermediate information values to thereby determine arithmetically the output information or the fire information value(s). The values of the intermediate information are not important. Accordingly, at the first step, the signal processing net is adjusted with regard to the first and second weight values by the adjusting means mentioned previously so that the relation between the input information values and the output information values can approximate the content of the definition table mentioned hereinbefore.

Although it has been described that the table storing a specific set of values one for each type of the detection information and a corresponding set of values one for each type of fire information is provided in association with the adjusting means for adjusting the weight values, wherein the contents of the table are first taught into the signal processing net by the adjusting means while adjusting the weight values so that the difference between a fire information value output from the signal processing net and the output value indicated in the table can be reduced to a minimum, it is also possible to prepare a storage means loaded with weight values forming the contents of the abovementioned table at a manufacturing step of the system to thereby spare the table and the adjusting means.

To this end, according to the present invention, there is also provided a fire alarm system in which values for various types of detection information output from a plurality of detecting means are subjected to signal processing for obtaining values for one or more types of fire information to thereby allow a fire decision to be made on the basis of said fire information values, the fire alarm system comprising:

a signal processing net responsive to the input of respective values for types of detection information to thereby impart corresponding weights to each value of the input detection information in accordance with the degree of contribution thereof to each value of fire information and arithmetically determine each value of fire information on the basis of the weighted detection information values; and storage means for storing weight values which are so set that a value for each type of fire information determined arithmetically when a specific set of values one for each type of detection information is supplied to the signal processing net approximates a desired value for each type of fire information to be obtained by the specific set, wherein the signal processing net imparts corresponding weights to each value of the input detection information by using weight values stored in the storage means.

BRIEF DESCRIPTION OF THE DRAWINGS

FIG. 2 and FIG. 2A are views showing definition tables employed in the first and second embodiments of the present invention, respectively;

FIG. 5B is a view showing a sensor level/duration time table stored in a storage area RAM14 shown in FIG. 1A;

FIG. 8 and FIG. 8A are views showing actual output data values of the net structure realized by the net structures generating program shown in FIG. 6 according to the first and second embodiments, respectively;

FIG. 9 and FIG. 9A are views showing individual weight values used for obtaining the data output values shown in FIG. 8 and FIG. 8A, respectively;

DETAILED DESCRIPTION OF THE PREFERRED EMBODIMENTS

In the following, the present invention will be described in conjunction with exemplary embodiments thereof.

Figure 1:
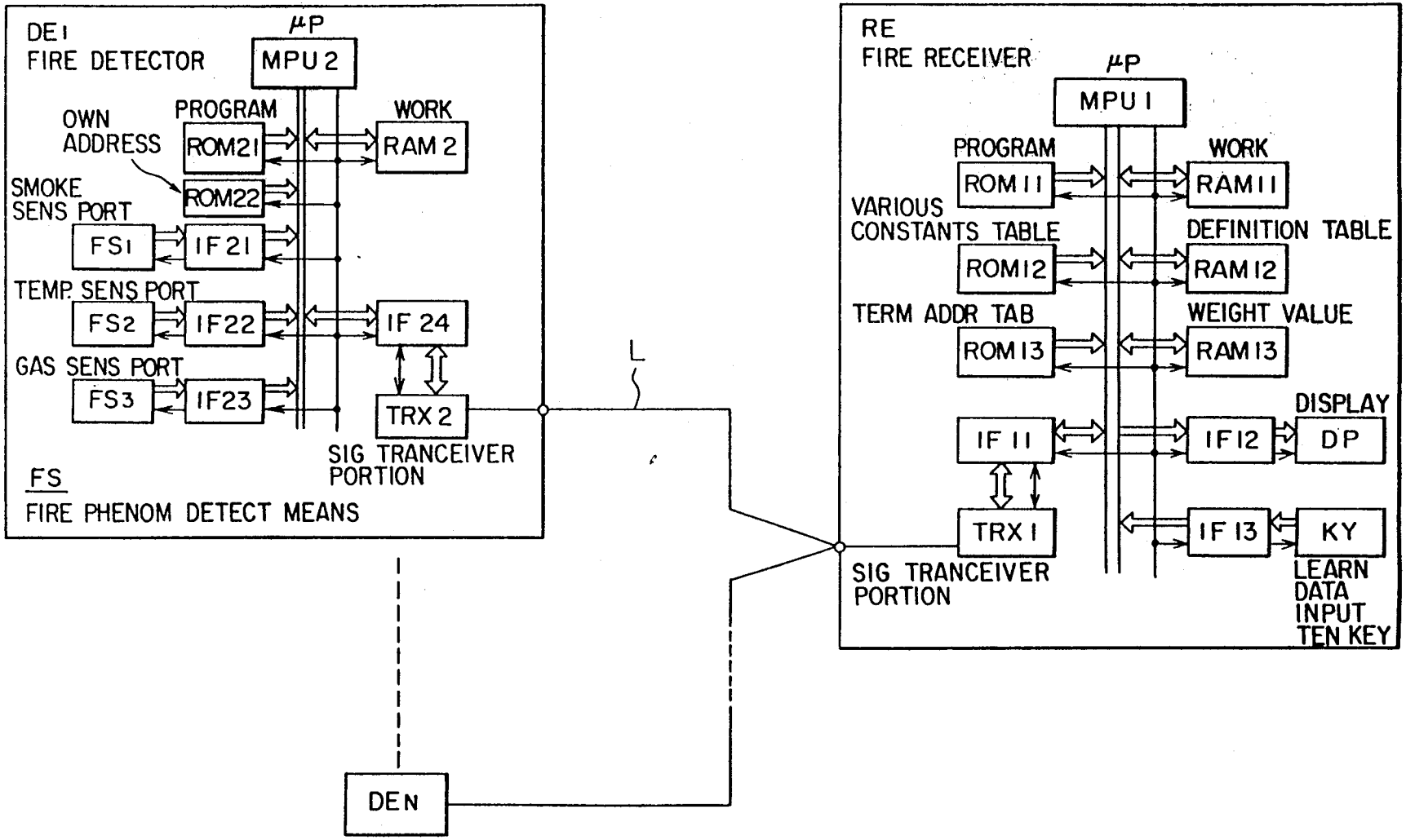
FIG. 1 and FIG. 1A are block circuit diagrams showing fire alarm systems according to first and second exemplary embodiments of the present invention, respectively.

FIG. 1 is a block diagram showing a so-called analog type fire alarm system to which the present invention is applied and in which sensor levels representative of analog physical quantities inherent to a fire phenomena as detected by individual fire detectors are sent out to receiving means such as a receiver (fire control panel), repeater or the like, wherein the receiving means is adapted to make decision as to occurrence of the fire on the basis of the sensor levels as collected. However, it goes without saying that the present invention can be equally applied to an on/off type fire alarm system in which the decision as to occurrence of the fire is made at the individual fire detectors, wherein only the results of the decision are sent to the receiving means.

In FIG. 1, reference character RE denotes a fire receiver or a fire control panel, and $DE_1$ to $DE_N$ designate N analog type multi-element fire detectors connected to the fire control panel RE by way of a transmission line L which may be constituted, for example, by a pair of lines serving for both electric power supply and signal transmission, in which only one of the fire detectors is illustrated in detail with respect to the internal circuit configuration. Parenthetically, it should be mentioned that not all of the N fire detectors, are necessarily multi-element fire detectors but instead such an arrangement may be adopted in which a set constituted by a plurality of different types of fire detectors corresponds to one multi-element fire detector. Accordingly, with the expression "n-th fire detector (n=1 to N)" used in the following description, it is intended to cover both the single multi-element fire detector and the set including a plurality of different type single-element fire detectors.

In the fire receiver or the fire control panel RE;

MPU1 denotes a microprocessor;

ROM11 denotes a program storage area storing those programs which are relevant to operation of the inventive system, as will be made apparent from description made hereinafter by reference to FIG. 4 to FIG. 7;

ROM12 denotes a various constants table storage area for storing a various constants table containing criteria etc. for discriminative identification of fires for all of the fire detectors;

ROM13 denotes a terminal address table storage area for storing addresses of the individual fire detectors;

RAM11 denotes a work area;

RAM12 denotes a definition table storage area for storing definition tables for all of the fire detectors, as will be described hereinafter;

RAM13 denotes a weight value storage area for storing weight values of signal lines for all the fire detectors, as will be described later on;

TRX1 denotes a signal transceiver portion which is constituted by a serial-to-parallel converter, a parallel-to-serial converter and others;

DP denotes a display such as a CRT or the like;

KY denotes a ten key for inputting learning data, as will be described hereinafter; and IF11, IF12 and IF13 denote interfaces.

Further, in connection with the multi-element fire detector DE1:

MPU2 denotes a microprocessor;

ROM21 denotes a program storage area;

ROM22 denotes a self address storage area;

RAM2 denotes a work area; and

FS denotes a fire phemonenon detecting means composed of sensor portions such as a smoke sensor portion $FS_1$ which may be, for example, a scattered light type, a temperature sensor portions $FS_2$ which may include, for example, a thermistor, and a gas sensor portion $FS_3$ including a gas detecting element and others. Each of the sensor portions $FS_1$, $FS_2$ and $FS_3$ is provided with an amplifier, a sample and hold circuit, an analog-to-digital converter and others, although they are not shown. Further:

TRX2 denotes a signal transceiver portion similar to TRX1; and

IF21, IF22, IF23 and IF24 denote interfaces. Although the first multi-element fire detector $DE_1$ is shown in FIG. 1 as being composed of the three sensor parts which are to serve as the fire phenomenon detecting means, it should be understood that the invention is not limited to the number and the types of the sensor portions shown in FIG. 1, but the number and the types of the sensor portions can be varied from one to another multi-element fire detector. Further, in the case of the set or unit in which a plurality of fire detectors are employed, the number and the types of the fire detectors assembled to the set can be changed as occasion requires.

In precedence to the concrete description of operation of the exemplary embodiment of the present invention with the aid of FIG. 4 to FIG. 7, description will first be directed to the concept underlying the invention.

With the present invention, it is contemplated to allow various decisions to be made rapidly and correctly as to the occurrence of a fire and the degree of danger on the basis of the signals supplied from a plurality of sensor portions (or a plurality of fire detectors in the case of the detector set) which detect different types of physical quantities on the basis of the fire phenomena. The principle underlying this concept will first be described with the aid of FIG. 2 and FIG. 3.

It is assumed, by way of example, that three sensor portions are employed, wherein a first sensor portion is constituted by a smoke sensor portion, a second sensor portion by a temperature sensor portion while a third sensor portion is constituted by a gas sensor portion. On this assumption, elucidation will be made for a case in which three fire decision values of fire probability (first fire information type), degree of danger (second fire information type) and smoldering fire probability (third fire information type) are to be determined in accordance with the sensor levels of the individual sensor portions. Parenthetically, with the term "fire", it is intended to mean fires inclusive of smoldering fires, while a smoldering fire means a state in which only smoke is produced without being accompanied by any combustion flames.

FIG. 2 shows a table of three fire decision values which are true or of significantly high accuracy and which are derived from 12 combinations of the sensor levels of the three sensor portions. This kind of table can be prepared accurately through experiments or by other empirical methods in consideration of the characteristics of the fire detectors or the detector set (which characteristics include the number and types of sensor portions), locations of the installation, etc. However, although it is practically impossible to prepare this sort of table for all the values instead of several combinations (e.g. 12 combinations) of the three sensor levels, according to the teachings of the present invention described subsequently, it is possible to accurately determine the fire decision values for all the values of the sensor levels.

Referring to FIG. 2, there are indicated in the three columns counted from the leftmost one the sensor levels of the smoke sensor portion (the value for a first type of detection information), the sensor level of the temperature sensor portion (the value for a second type of detection information) and the sensor level of the gas sensor portion (the value for a third type of detection information), respectively, while indicated in three columns in the right half of the table are the level of the fire probability $T_1$ (the value for the first type of fire information), the level of degree of danger $T_2$ (the value for the second type of fire information) and the level of the smoldering fire probability $T_3$ (the value for the third type of fire information) in the range of 0 (zero) to 1 (one) in correspondence to the sensor levels of the three sensor sections shown in the three left columns, respectively. The sensor levels of the individual sensor portions indicated in the three left columns are also converted into values in the range of 0 to 1, wherein the value range of 0 to 1 of the smoke sensor portion may correspond to a smoke concentration of, for example, 0 to 20%/m detected by the smoke sensor portion, the value range of 0 to 1 of the temperature sensor portion may correspond to a temperature rise rate of 0 to 10° C./minute detected by the temperature sensor portion, and the value range of 0 to 1 of the gas sensor portion may correspond to a concentration of carbon monoxide (CO) of 0 to 100 ppm detected by the gas sensor portion, respectively.

Figure 3:
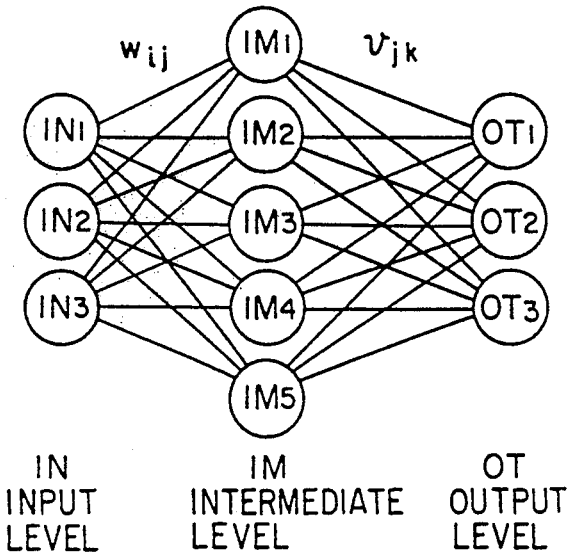
FIG. 3 and FIG. 3A are views for conceptually illustrating signal processing nets employed in the first and second embodiments of the present invention, respectively.

Now, in describing the operation of the present invention, a net structure as illustrated in FIG. 3 will be assumed. This net structure is designed to supply the sensor levels of the individual sensor portions to input layers to thereby obtain the individual fire decision values from output layers with high accuracy on the assumption that such net structures are incorporated in the fire receiver or the fire control panel RE in correspondence with the individual fire detectors. In the net structure shown in FIG. 3, the three inputs $IN_1$, $IN_2$ and $IN_3$ indicated on the left side will be referred to as the three input layers. Input to these input layers are signals from a smoke senor, signals from a temperature sensor and signals from a gas sensor, each of these signals having been converted to the values in the range of 0 to 1. Also, if the layers $OT_1$, $OT_2$ and $OT_3$ indicated at the right side are termed the output layers, there are output from these output layers a fire probability, degree of danger and smoldering fire probability, each being represented by a value in the range of from 0 to 1 in the case of the illustrated embodiment of the present invention. Further, five layers $IM_1$–$IM_5$ shown, only by way of example, are referred to as intermediate layers, respectively. These intermediate layers $IM_1$–$IM_5$ receive the signals from the individual input layers $IN_1$–$IN_3$ and output the signals to the individual output layers $OT_1$–$OT_3$. It is assumed that the signals necessarily travel from the input layers to the output layers without traveling in the opposite direction and without undergoing signal-coupling within the same layer. It is additionally assumed that no direct signal coupling is made from the input layer to the output layer. Accordingly, there exist 15 signal lines extending from the input layers to the intermediate layers. Similarly, 15 signal lines extend from the intermediate layers to the output layers.

The signal lines shown in FIG. 3 have respective weight values or coupling degrees which vary depending on the values to be output from the output layers in response to the signals input through the input layers, wherein signal transmission capability of the signal line is increased as the weight value thereof becomes large. The weight values of 15 signal lines between the input layers and the intermediate layers and between the intermediate layers and the output layers, respectively, are stored in the weight value storage area RAM13 at the areas allocated to the individual fire detectors, respectively, wherein the stored contents are altered or updated in accordance with the relations between the inputs and the outputs.

In more concrete terms, the inputs of the smoke sensor portion, the temperature sensor portion and the gas sensor portion listed in the table of FIG. 2 in the leftmost three columns are supplied to the input layers $IN_1$, $IN_2$ and $IN_3$ in accordance with a net generating program described hereinafter, wherein the values output from the output layers $OT_1$, $OT_2$ and $OT_3$ in response to the inputs mentioned above are compared with the fire probability value $T_1$, the degree of danger value $T_2$ and the smoldering fire probability value $T_3$ listed at the rightmost three columns of the table shown in FIG. 2 and serving as the teacher signals or the learned data, and the weight values of the signal lines are changed so that the error or difference resulting from the comparison is reduced to a minimum. In this manner, data very closely approximating all the functions in the table of FIG. 2 in which only 12 items are shown can be taught in the net structure shown in FIG. 3.

Now assuming that the weight value between the input layer INi and the intermediate layer IMj is represented by Wij with the weight value between the intermediate layer IMj and the output layer OTk being represented by Vjk, where $i=1\sim I$ ($I=3$ in the case of the instant embodiment), $j=1\sim J$ ($J=5$ in the case of the instant embodiment) and where $k=1\sim K$ ($K=3$ in the case of the instant embodiment) and further assuming that each of the weight values Wij and Vjk can have positive, zero or negative values, the total sum $NET_1(j)$ of the inputs to the intermediate layer IMj is given by $$NET_1(j) = \sum_{i=1}^{I} (INi \cdot Wij) \quad \text{(Eq. 1)}$$

where INi represents the input value to the input layer INi. When the value $NET_1(j)$ is converted to a value in a range of 0 to 1 with the aid of a sigmoid function, for example, which is then represented by IMj, the following relation applies:

$$IMj = \frac{1}{1 + EXP[-NET_1(j) \cdot \gamma_1]} \quad \text{(Eq. 2)}$$

Similarly, the total sum $NET_2(k)$ of the inputs to the output layer OTk is expressed by:

$$NET_2(k) = \sum_{j=1}^{J} (IMj \cdot Vjk) \quad \text{(Eq. 3)}$$

When the value $NET_2(k)$ is converted to a value in the range of 0 to 1 by the sigmoid function, which is then represented by OTk, the following relation applies:

$$OTk = \frac{1}{1 + EXP[-NET_2(k) \cdot \gamma_2]} \quad \text{(Eq. 4)}$$

In this manner, the relations between the input values $IN_1$, $IN_2$ and $IN_3$ and the output values $OT_1$, $OT_2$ and $OT_3$ can be represented by the expressions Eq.1 to Eq.4 by using the weight values. In the above expressions, $\gamma_1$ and $\gamma_2$ represent adjustment coefficients of the sigmoid curve. In the case of the instant embodiment, they can appropriately be selected such that $\gamma_1=1.0$ and $\gamma=1.2$.

The net generating program may be prepared as described below. Namely, when one of the 12 combinations of the smoke sensor input $IN_1$, the temperature sensor input $IN_2$ and the gas sensor input $IN_3$ stored in the definition table RAM12 shown in FIG. 2 is input to the input layers, the actual outputs $OT_1$, $OT_2$ and $OT_3$ are output from the output layers as the result of calculations according to the Eq.1 to Eq.4 mentioned above to be subsequently compared with the teacher signal outputs $T_1$, $T_2$ and $T_3$ shown on the right side in FIG. 2, respectively, whereon a sum Em of the error in the individual output layers where $m=1\sim M$ ($M=12$ in the case of the instant embodiment) is represented by the following expression:

$$Em = \sum_{k=1}^{K} \tfrac{1}{2} (OTk - Tk)^2 \quad \text{(Eq. 5)}$$

where OTk represents the value determined in accordance with Eq.4 mentioned hereinbefore. The value E totaling the error sums Em for all of 12 (=M) combinations contained in the table of FIG. 2 is given by $$E = \sum_{m=1}^{M} (Em) \quad \text{(Eq. 6)}$$

Finally, operation is effected to adjust the weight values of the signal lines one by one so that the value E given by Eq.6 becomes minimized. The weight values stored in the fire detector area of the storage area RAM13 are updated with these new weight values to be utilized in the ordinary fire monitoring operation. The adjustment of the weight values for the signal lines as described above is performed for all the fire detectors included in the fire alarm system.

Upon completion of the teaching of the table contents shown in FIG. 2 for the net structure illustrated only conceptually in FIG. 3, i.e. upon completion of adjustment of the weight values of the signal lines on a line-by-line basis, the actual fire monitoring operation is performed by determining through calculation with the aid of a net calculation program described hereinafter the values produced from the individual output layers of the net structure in response to the input values supplied to the net structure from the individual sensor portions in accordance with Eq. 1 to Eq. 4 mentioned above, whereupon a fire decision is made by comparing the values resulting from the above calculation with the reference values of the fire probability, degree of danger and the smoldering fire probability, respectively.

FIG. 4 to FIG. 7 are flow charts for illustrating the operation of the inventive system executed in accordance with programs stored in the storage area ROM1 shown in FIG. 1.

Figure 4:
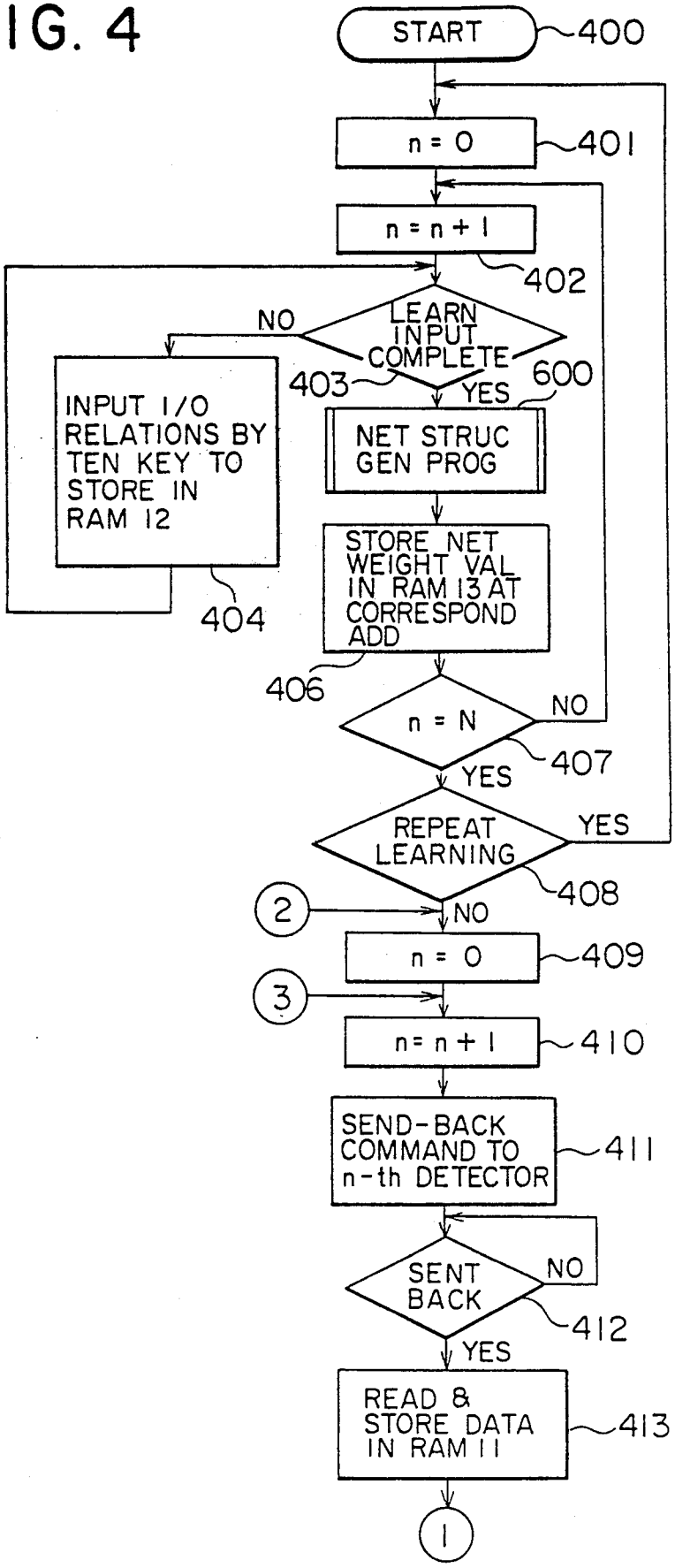
FIG. 4 is a flow chart for illustrating operations of the systems shown in FIG. 1 and FIG. 1A.

Referring to FIG. 4, the net structure generating program is executed sequentially for each of the N multi-element fire detectors or for each set including several types of the fire detectors shown in FIG. 1 sequentially, starting from the first numbered fire detector.

Describing the operation of the net structure generating program for the n-th fire detector ($n=1\sim N$), the definition table contents described previously by reference to FIG. 2 are first given as the input for the teacher or input for learning through the learning data input ten key KY (step 404). Since the definition table contents differ from one to another fire detector in respect to the number and the types of the multi-element sensor portions, installation environment and/or characteristics of the fire detectors themselves, the definition table is prepared for each of the fire detectors or for each of the sets including plural types of fire detectors.

Figure 6:
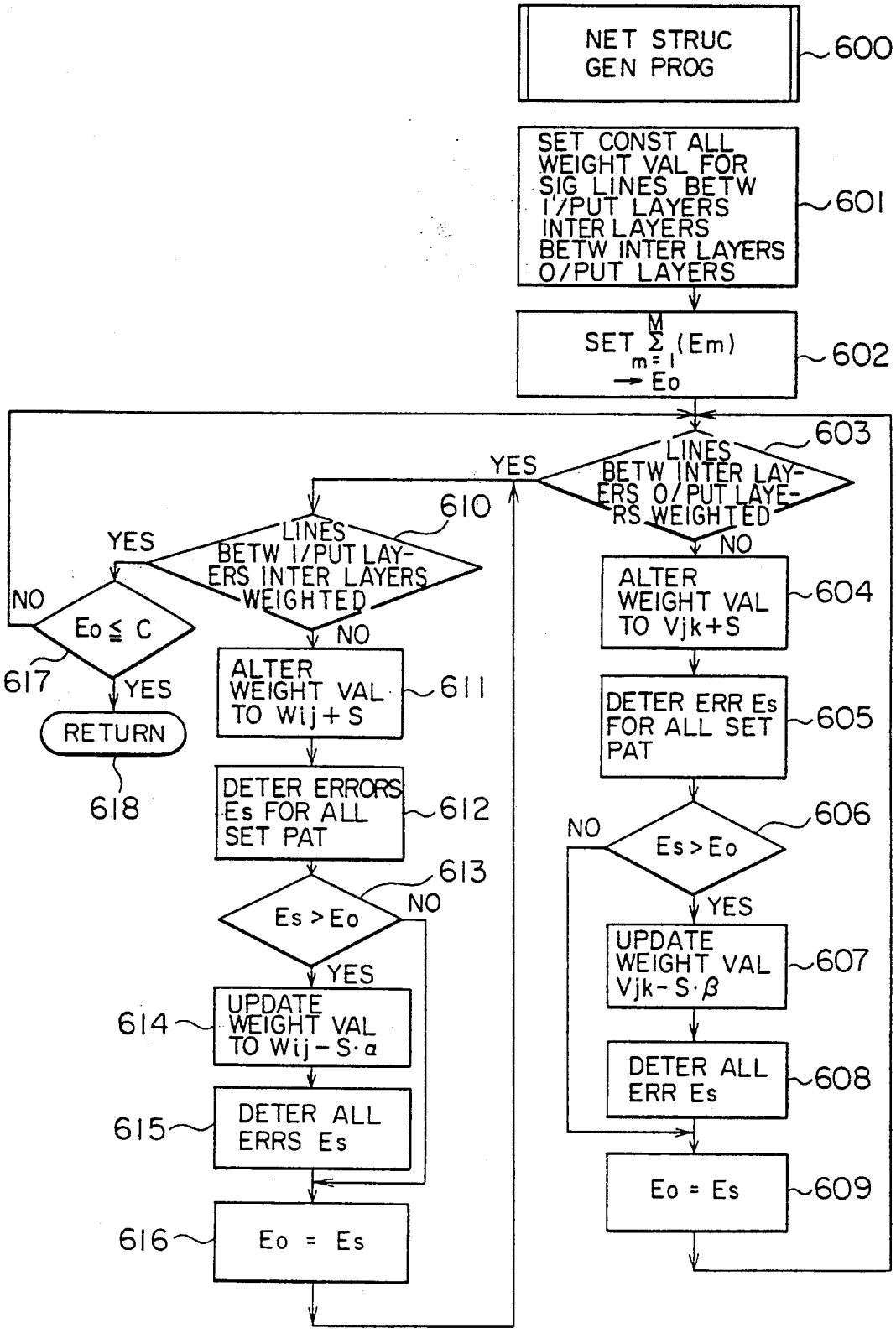
FIG. 6 is a flow chart for illustrating a net structure generating program (weight value adjusting means) shown in FIG. 4.

When the contents of the definition table for the n-th fire detector are stored in the n-th fire detector area provided in the definition table storage area RAM12 by means of the ten key KY, then the net structure generating program 600 illustrated in FIG. 6 is executed.

As described in FIG. 3, thirty signal lines are provided between the input layers and the intermediate layers, and between the intermediate layers and the output layers. The weight values Wij and Vjk of said thirty signal lines stored in the storage area of the RAM 13 for the n-th fire detector are first set at given constant values (step 601). Subsequently, on the basis of the weight values set to be constant, the totaled value (E in Eq.6) of the squares of errors between the output values OT and the teacher output values T are determined in accordance with Eq.1 to Eq.6 for all the 12 combinations listed in the definition table of FIG. 2, wherein the result as obtained is represented by $E_o$ (step 602).

Next, operation is performed to adjust one by one the weight values of the fifteen signal lines between the intermediate layers and the output layers so that the totaled error value $E_o$ is minimized for the input of the same definition table contents (N of a step 603). Because the adjustment of the weight values are only for the signal lines extending between the intermediate layers and the output layers, no changes occur in the values determined in accordance with the expressions Eq.1 and Eq.2. At first, the weight value $V_{11}$ of the first one signal line is changed to a weight value of $V_{11}+S$ (step 604) and the calculations are performed in accordance with the expressions Eq.3 to Eq.6. The totaled error value E finally determined from the expression Eq.6 is represented by $E_s$ (step 605). Then, the value of $E_s$ is compared with the totaled error value $E_o$ before changing the weight value.

If $E_s \leqq E_o$ (N of step 606), the value $E_s$ is set as a new value of $E_o$ (step 609), while the updated weight value of $V_{11}+S$ is stored at an appropriate location of the work area.

On the other hand, when $E_s > E_o$ (Y of step 606), this means that the direction in which the weight value has been changed is erroneous. Accordingly, the weight value is changed in the opposite direction starting from the original weight value $V_{11}$ (step 607), being followed by the calculation of $E_s$ by using a weight value of $V_{11}-S\cdot\beta$ in accordance with Eq.3 to Eq.6 (step 608), wherein the value of $E_s$ thus determined is set as the new or updated value of $E_o$ (step 609), while the altered weight value of $V_{11}-S\cdot\beta$ is stored at an appropriate location in the work area.

It should be mentioned that $\beta$ is a coefficient proportional to $|E_s-E_o|$.

After completion of the alteration and adjustment of the value of $V_{11}$ through the steps 604 to 609, the alteration and adjustment of the weight values $V_{12}$, $V_{13}$, $V_{21}\sim V_{23}, \ldots, V_{51}\sim V_{53}$ for the fifteen signal lines are then sequentially performed in the same manner through processing steps 604 to 609.

Upon completion of the adjustment of the weight values Vjk for all the signal lines extending between the intermediate layers and the output layers (Y of step 603), a similar adjustment is next performed on the weight values Wij for the signal lines between the input layers and the intermediate layers at steps 610 to 616 all in accordance with Eq.1 to Eq.6 so that the error can be minimized.

When the adjustment of the weight values for all the signal lines has been completed (Y of step 610), the value $E_o$ decreased in this way is compared with a predetermined value C. When the former is still greater than the value C (N of a step 617), the step 603 is regained for further reducing the error, wherein the procedure for adjustment of the weight values between the intermediate layers and the output layers through the steps 604 to 609 described above is repeated again. When the value $E_o$ becomes equal to or smaller than the predetermined value C after the repeated adjustment (Y of step 617), the processing proceeds to step 406 shown in FIG. 4, where the altered and adjusted individual weight values Vjk and Wij for the thirty signal lines are stored in the associated n-th fire detector area of the storage area RAM13 at the corresponding addresses, respectively.

Through the operation described above, the values of S, $\alpha$, $\beta$, C, etc. are stored in the storage area ROM12 for the various constants table.

Since the final error value of $E_o$ does not assume zero, the adjustment of the weight values for the signal lines has to be terminated at an appropriate value. In this conjunction, it is noted that in addition to the termination of the adjustment at the time point when $E_o$ becomes equal to or smaller than C, as indicated at step 617, it is also possible to previously determine the number of times the adjustment of the weight value is to be performed, wherein the adjustment is automatically ended when the predetermined number of times has been attained.

FIG. 8 shows, by way of example only, actually measured values of the fire probability, the degree of danger and the smoldering fire probability for three sensor portions, i.e. a smoke sensor portion, a temperature sensor portion and the gas sensor portion after the adjustment at steps 603 to 616 has been repeated 183 times. The pattern numbers shown in FIG. 8 coincide with those found in the definition table shown in FIG. 2, wherein the data at the topmost row in the field labeled with the pattern number in FIG. 8 correspond with the values of the smoke sensor $IN_1$, the temperature sensor $IN_2$ and the gas sensor $IN_3$ shown in FIG. 2, respectively. The data in the middle row correspond to the values of the teacher signal outputs of the fire probability $T_1$, the degree of danger $T_2$ and the smoldering fire probability $T_3$ shown in FIG. 2, respectively. The data on the bottom row represent the actually measured values $OT_1$, $OT_2$ and $OT_3$ of the fire probability, the degree of danger and the smoldering fire probability, respectively. There is shown a value calculated in accordance with the expression Eq. 6 at the lower right corner of FIG. 8. Further, FIG. 9 shows the various weight values with which the actually measured values shown in FIG. 8 are obtained.

Figure 10:
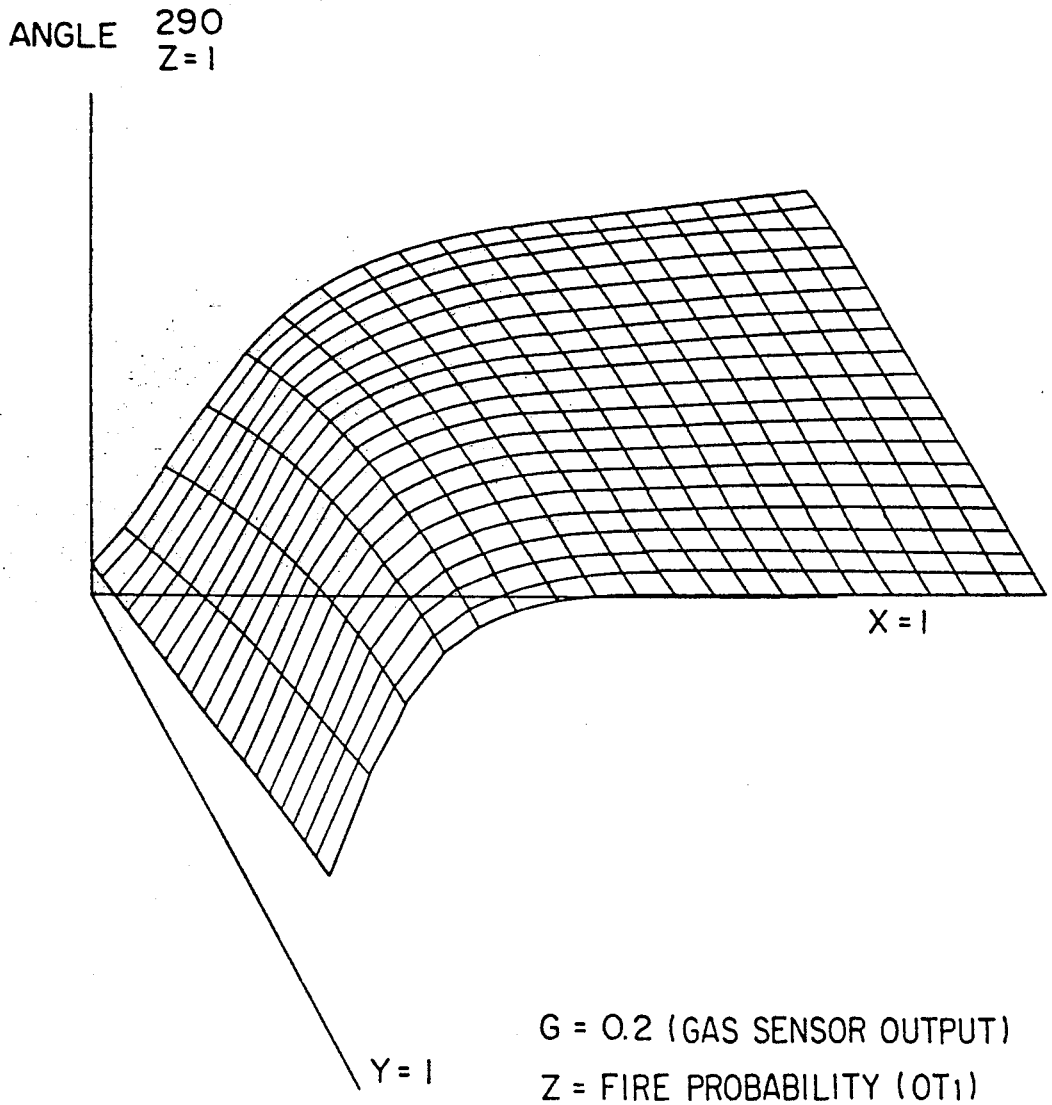
FIG. 10, FIG. 11 and FIG. 12 are views showing the output values of the signal processing net according to the first embodiment, in which the probability of a fire, degree of danger and the probability of a smoldering fire are shown along the Z-axis for smoke sensor levels (X-axis) and temperature difference sensor levels (Y-axis) with the gas sensor output being assumed to be constant.
Figure 11:
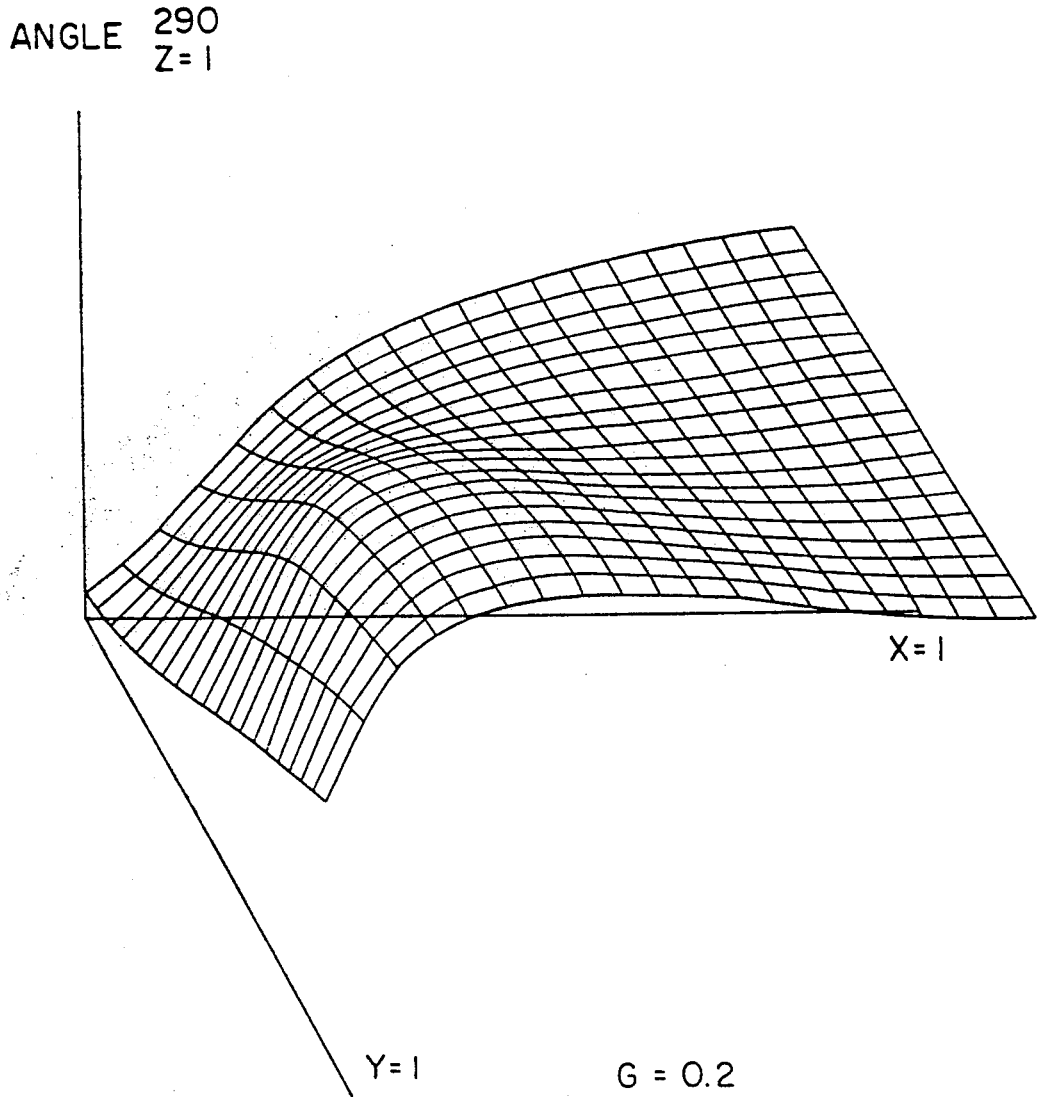
Figure 12:
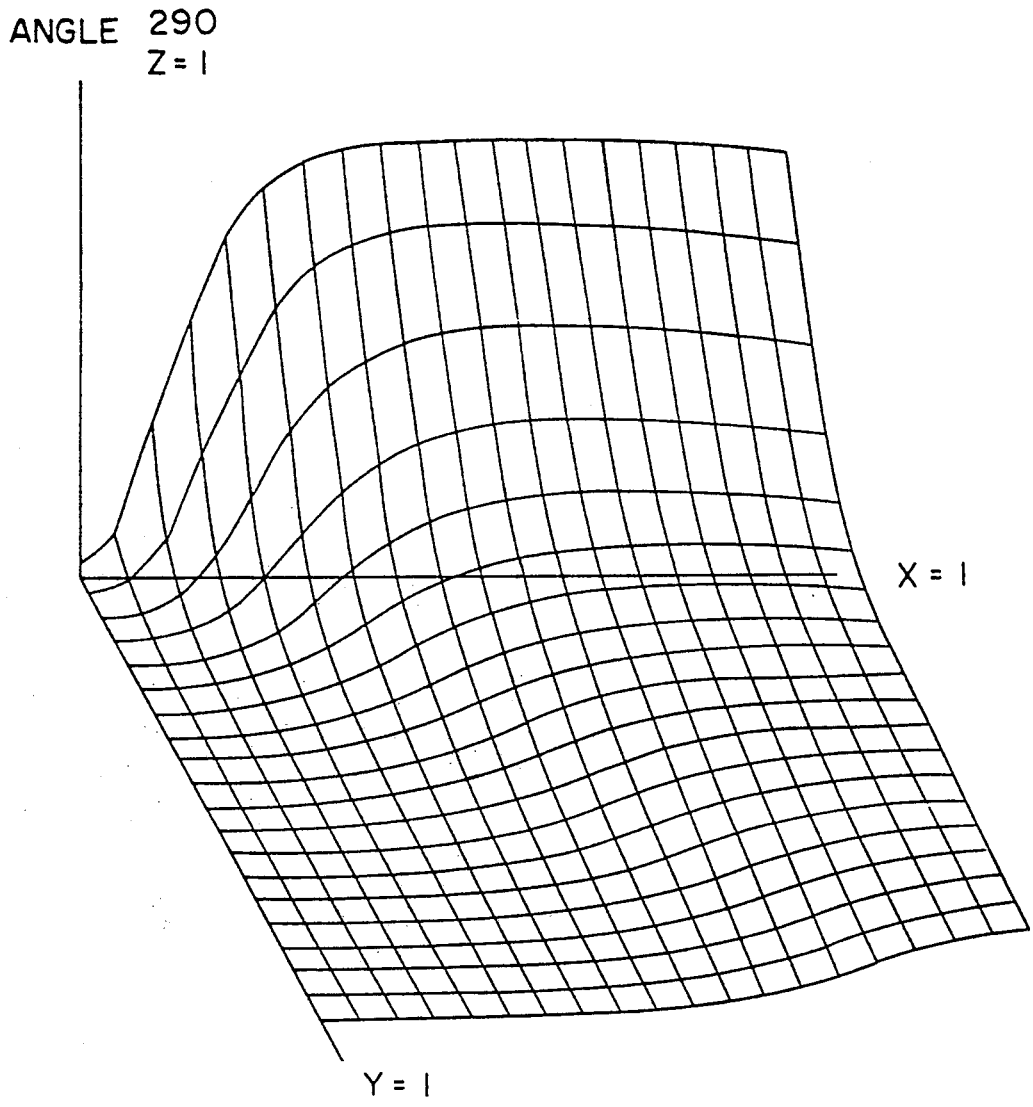

FIG. 10 to FIG. 12 are views showing the fire probability $OT_1$, the degree of danger $OT_2$ and the smoldering fire probability $OT_3$, respectively, taken along the Z axis with the smoke sensor output and the temperature sensor output being taken along the X-axis and the Y-axis, respectively, on the assumption that the output G of the gas sensor is constant at 0.2.

By defining the output values of the three sensors and the fire probability, the degree of danger and the smoldering fire probability of terms of 12 patterns as elucidated above, those combinations of the sensor outputs which are not contained in the definition table can be determined through interpolation by the net structure, whereby the optimum output is produced as the indication or answer. While the instant embodiment shows a case with three inputs to and three outputs from the net structure, it will readily be understood that the sensor input number as well as the net output number can be increased or decreased, as occasion requires. Besides, there may be conceived as the outputs a variety of combinations inclusive of the probability of being no fire, visible distance, walking speed, probability of fire extinguishing and others.

When the adjustment of the weight values for the signal lines has been performed for all of N fire detectors incorporated in the fire alarm system (Y of a step 407) and when it is decided that there is no necessity for the repeated learning (N of step 408), then the fire monitoring operation of the fire detectors is activated sequentially, starting from the first fire detector.

Describing the fire monitoring operation in connection with the n-th fire detector DEn, a data send-back command for the n-th fire detector DEn is sent onto the signal line L from the signal transmission/reception part TRX1 through the interface IF11 (step 411).

Upon reception of the data send-back command by the n-th fire detector DEn which is assumed to be constituted by a multi-element fire detector, the latter sends en bloc the sensor levels representative of the physical quantities inherent to the fire phenomena such as smoke, heat, gases and others detected by the various sensor portions in accordance with the relevant program stored in the program storage area ROM21. On the other hand, when the n-th fire detector DEn is constituted by a set consisting of a plurality of constituent fire detectors, the fire receiver i.e. fire control panel RE collects the sensor levels of the plural fire detectors belonging to the concerned set, whereupon the decision as to the fire is made on the basis of the sensor levels as collected. For data acquisition of this kind, an ordinary polling technique can be adopted. However, use can also be made of the systems described in the specifications of the below mentioned patent applications 1)~3) filed in the name of the same inventor and applicant as those of the present application.

1) In Patent Application SHO 63-168986 filed on Jul. 8, 1988 under the title "Fire Alarm Equipment", there is described a system in which a start address is assigned to a first one of fire phenomenon detecting portions, i.e. plural sensor portions of a multi-element fire detector, while the remaining fire phenomenon detecting portions are assigned with associative addresses associated with the start address, wherein in response to a data send-back command issued by a fire receiver i.e. a fire control panel to a given one of the addresses, the fire phenomenon detecting portion corresponding to that address sends the data as detected to the fire receiver i.e. the fire control panel.

2) In Patent Application SHO 63-201861 filed on Aug. 15, 1988 under the title "Fire Alarm Equipment", there is described a system in which a receiving portion, i.e. the fire control panel stores information of the species of one or a plurality of sensor portions or fire phenomenon detecting portions incorporated in each of fire detectors in corresponding relation with the latter, wherein upon collection of the fire monitoring information from the individual fire detectors, address signals of the fire detectors to be polled are sent out together with the species information corresponding to the fire monitoring information required for these types of information of the fire detector(s), and wherein the fire detector responds to the reception of the type of information sent thereto through the polling from the fire control panel to thereby send out the fire monitoring information available from the fire phenomenon detecting portion designated by the abovementioned corresponding type information.

3) In Patent Application SHO 63-209356 filed on Aug. 25, 1988 under the title "Fire Alarm Equipment", there is described a system in which each of a plurality of fire detectors is provided with type information of fire phenomenon detecting portions incorporated in the fire detector as set by first means and sends out one or a plurality of type information in response to a first type information request issued by a receiver or a fire control panel, the sequence of the species information as sent out being stored, wherein in response to the request for fire monitoring information from the fire control panel, individual fire monitoring information obtained from one or a plurality of fire phenomenon detecting portions is sent out in the sequence as stored, while the receiver first stores therein the type information received from the fire detectors in the receiving order in correspondence with the address of the fire detectors, and wherein upon reception of the fire monitoring information from the fire detector, decision is made as to which of the fire phenomenon detecting portions the fire monitoring information as received originates in by collating the receiving order of the received fire monitoring information with the abovementioned stored type information.

Upon reception of the send-back data from a plurality of sensor portions constituting the n-th fire detector DEn (Y of a step 412), the data or the sensor levels as sent back are temporarily stored in the work area RAM11 (step 413) and subsequently converted to the values INi ($i=1\sim3$) in the range of 0 to 1 to be utilized as the detected value $IN_1$ of the smoke sensor portion, the detected value $IN_2$ of the temperature sensor portion and the detected value $IN_3$ of the gas sensor portion in the case of the instant embodiment (step 414).

Figure 5:
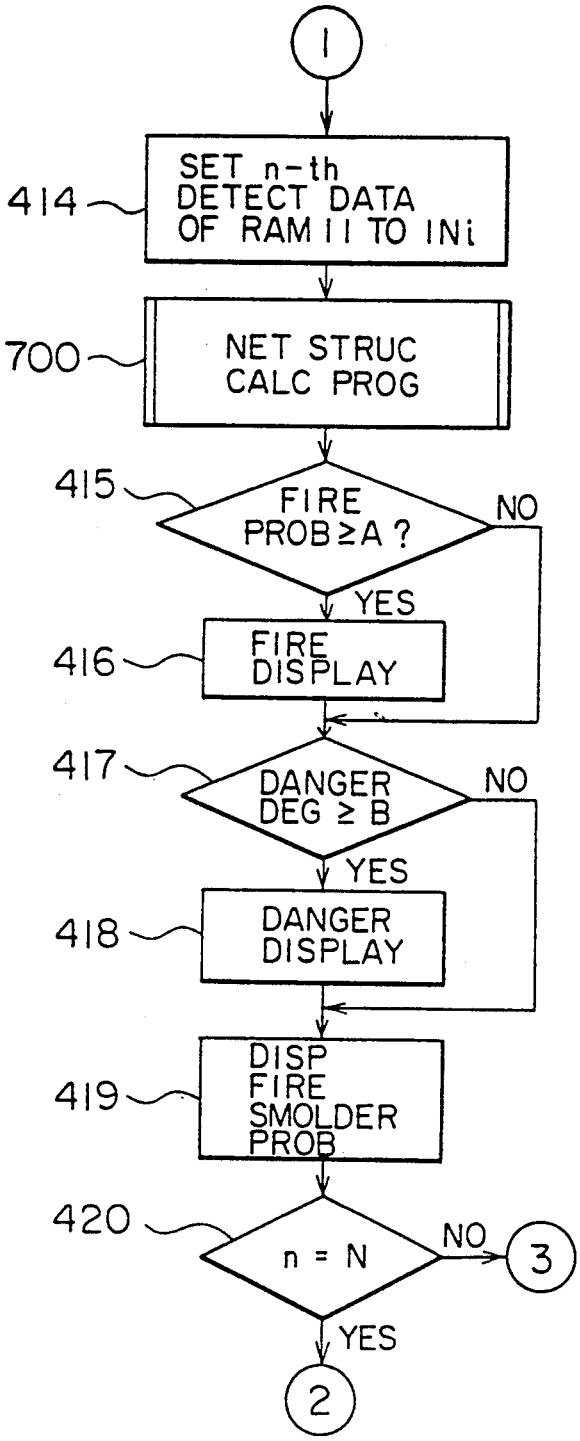
FIG. 5 and FIG. 5A are flow charts for illustrating operations of the systems of FIG. 1 and FIG. 1A.
Figure 5A:
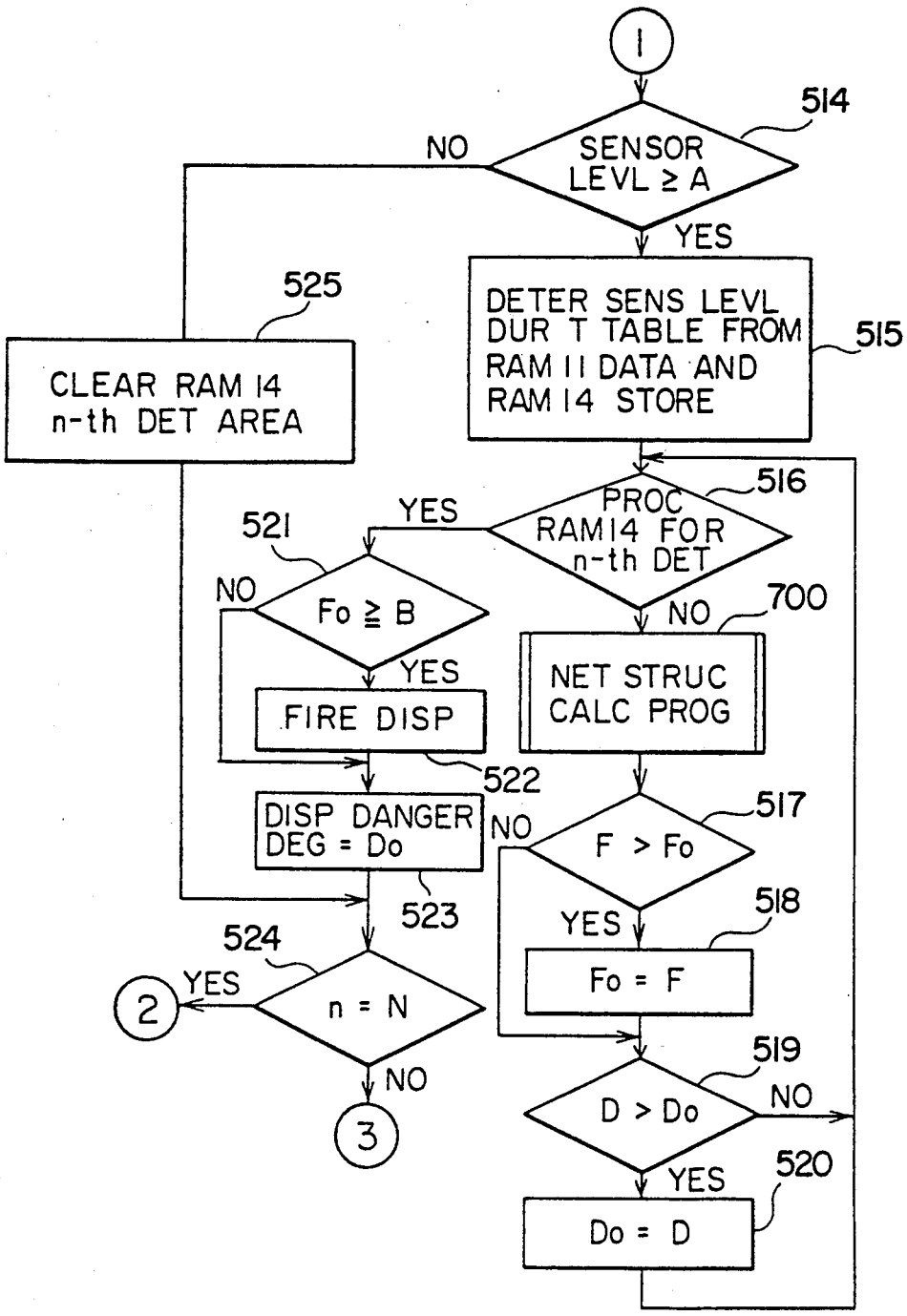
Figure 7:
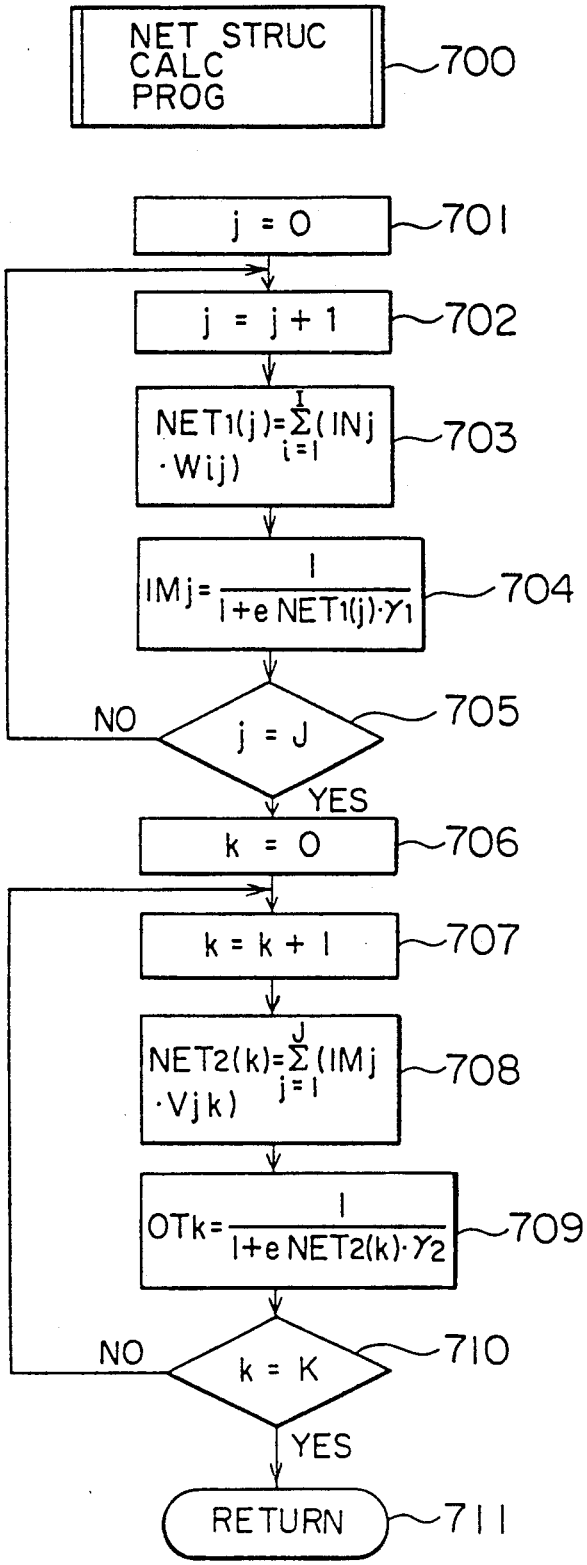
FIG. 7 is a flow chart for illustrating net structure calculation programs shown in FIG. 5 and FIG. 5A.

When the values of INi have been determined, the net structure calculation program 700 illustrated in FIG. 7 is activated, whereon $NET_1(j)$ is arithmetically determined in accordance with the expression Eq. 1 mentioned hereinbefore (step 703), the value resulting from which is then converted into the value IMj in accordance with the expression Eq. 2 (step 704). When the values IMj values are determined for all of $IM_1$ to $IM_5$ (Y of step 705), then $NET_2(k)$ is calculated by using these values IMj in accordance with the previously mentioned expression Eq. 3 (step 708), the values resulting from the calculation being converted into the values OTk as per Eq. 4 (step 709). When the values of OTk have been determined for all of $OT_1$ to $OT_3$ (Y of a step 710), the processing illustrated in the flow chart of FIG. 5 is regained. The values of $OT_1\sim OT_3$ represent the fire probability, the degree of danger and the smoldering fire probability, respectively.

Now, referring to FIG. 5, the value of $OT_1$ is first compared with a reference value A of the fire probability read out from the various constants table storage area ROM12. When $OT_1 \geqq A$ (Y of a step 415), a fire indication is issued (step 416), while the value of $OT_2$ is compared with a reference value B of the degree of danger read out similarly from the storage area ROM12 (step 417), wherein when $OT_2 \geqq B$, danger indication is issued (step 418), and the value of $OT_3$ is displayed as the probability of a smoldering fire (step 419).

Through the procedure described above, the fire monitoring operation for the n-th fire detector comes to an end, whereupon a similar fire monitoring operation is performed for the next fire detector.

Although it has been assumed in the foregoing that a plurality of fire phenomenon detecting means set in a group are of the types differing from one another, it should be understood that the plurality of fire phenomenon detecting means may be of the same type and installed at different locations (within a same room or zone). Further, instead of providing a definition table for a plurality of fire phenomenon detecting means constituting a group, the table may be provided in common to groups installed at places similar to one another.

In the following, description will be made as to a second preferred embodiment of the present invention by referring to FIG. 1A, FIG. 2A, FIG. 3A, FIG. 4, FIG. 5A, FIG. 5B, FIG. 6, FIG. 7, FIG. 8A, FIG. 9A, FIG. 10A, FIG. 11A, FIG. 12A and FIG. 13.

Figure 13:
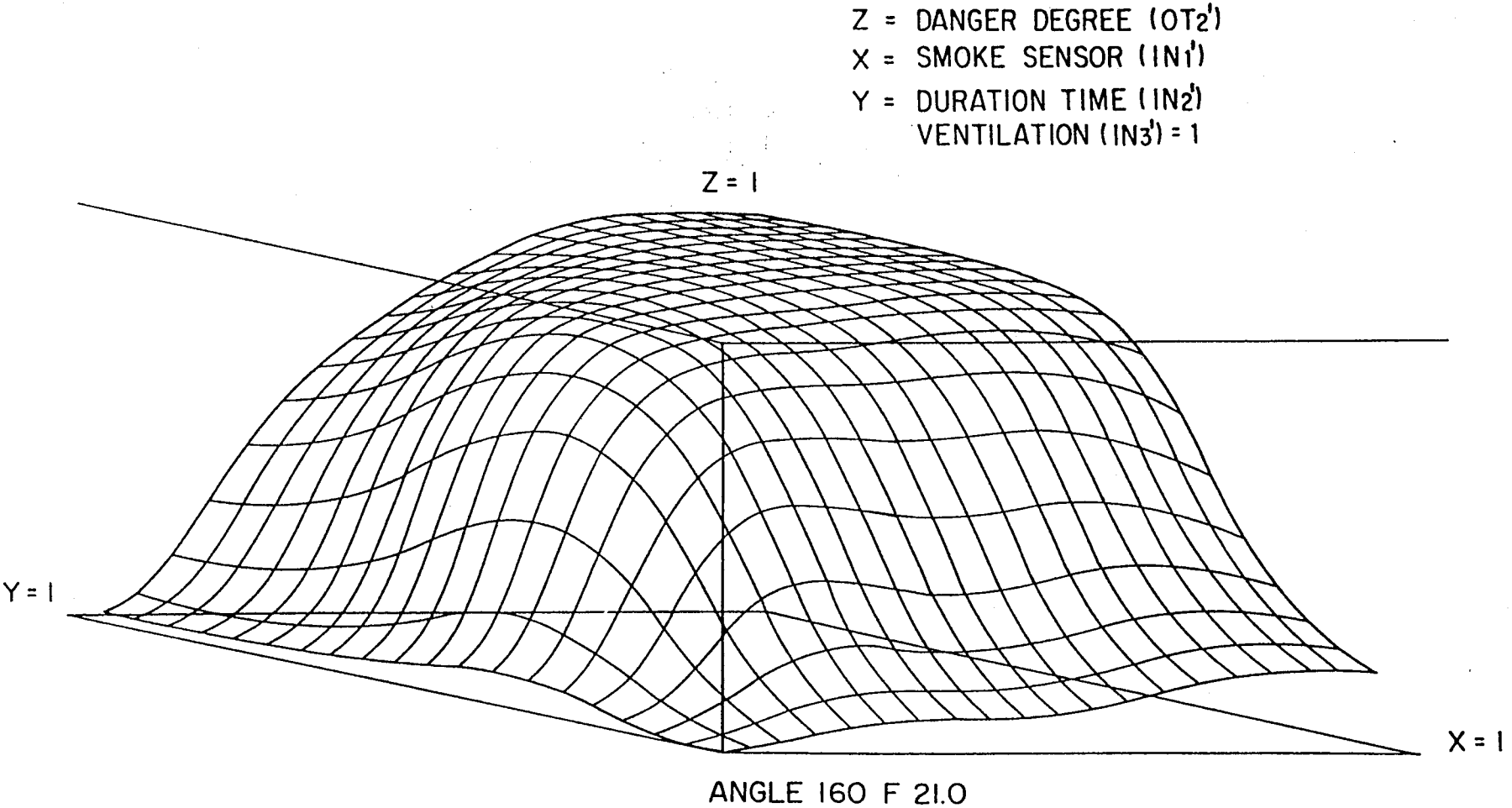

At first, it should be mentioned that those drawings showing the second exemplary embodiment of the same type as those referred to in the description of the first embodiment are labeled with the same figure numbers used in conjunction with the first embodiment with the addition of an A or B. Since FIG. 4, FIG. 6 and FIG. 7 remain the same as in the case of the first embodiment, these figures are used as they are without being affixed with an A or B. FIG. 13 is drafted for the second embodiment only.

Figure 1A:
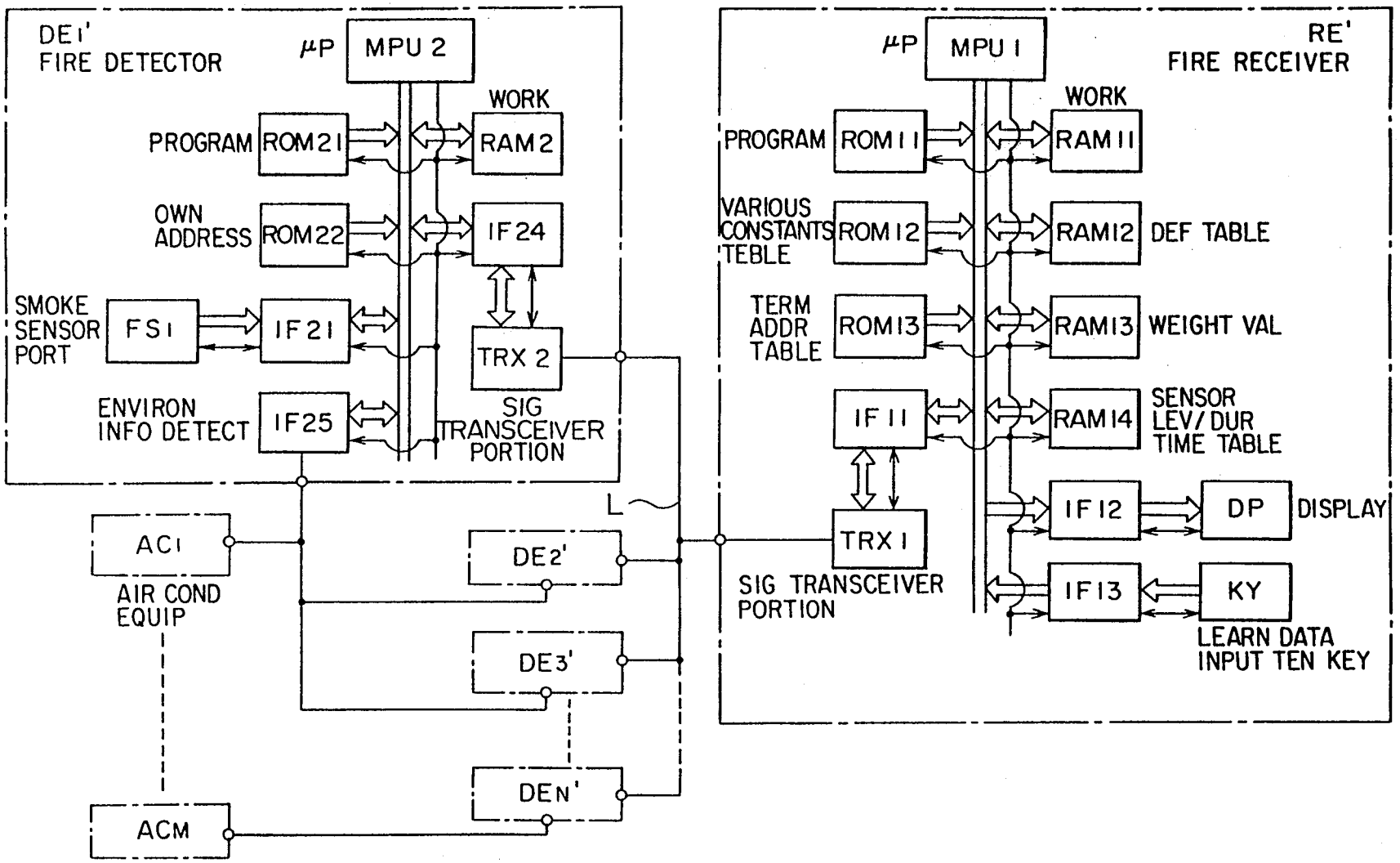

FIG. 1A shows a block diagram of a so-called analog type fire alarm system to which the present invention is applied and in which sensor levels representing the physical quantities produced by fire phenomena and detected by the individual fire detectors are sent to receiving means such as a fire control panel, repeater or the like, wherein the receiving means is adapted to make the decision concerning the occurrence of fire on the basis of the sensor levels. It goes without saying that the invention can equally be applied to an on/off type fire alarm system in which the fire decision is performed on the individual fire detectors with only the results of the decision being sent to the receiving means.

Referring to FIG. 1A, N analog type fire detectors $DE_1' \sim DE_N'$ are connected to a fire receiver or a fire control panel RE' by way of a transmission line L constituted, for example, by a power supply line and a signal transmission line, as in the case of the system shown in FIG. 1, wherein the internal circuit configuration is shown in detail for only one fire detector $DE_1'$. The individual fire detectors are also connected to associated air conditioners $AC_1 \sim AC_M$, respectively, so as to be able to receive signals representative of the operating states of the respective air conditioners as environmental information.

In this case, the individual fire detectors $DE_l'$ to $DE_N'$ are not connected in a one-to-one corresponding relation with the air conditioners $AC_l$ to $AC_M$, but a single air conditioner may be associated with a plurality of fire detectors or alternatively a plurality of air conditioners may be provided in association with a single fire detector. In the case of the example shown in FIG. 1A, the air conditioner $AC_l$ is destined to serve for the air conditioning of a place (room or zone) in which the fire detectors $DE_l'$ to $DE_3'$ are installed, while the air conditioner $AC_M$ is destined to serve for the air conditioning of a place where the fire detector $DE_N'$ is installed.

Parenthetically, in FIG. 1A, the air conditioners $AC_l$ to $AC_M$ are assumed, by way of example, to be distributively installed at every floor. When an air conditioner is installed in an underground room or on a rooftop (as in the case of a centralized system), the fire receiver or a fire control panel RE' may be provided with an interface for detection (collection) of environmental information, to thereby collect information on ventilation in the places where the individual fire detectors are installed.

Although information on the state of ventilation is handled as environmental information in the case of the second embodiment shown in FIG. 1A, it is equally possible to use in addition to information on the operating state of the air conditioner such as the ventilation information, such information as sizes and types of rooms, on- or off-state of lighting, types and amounts of combustibles, humidity, if there are comings and goings of unspecified number of people, etc.

The structure of the fire receiver i.e. fire control panel RE' corresponds to that of the fire control panel RE shown in FIG. 1 which is however additionally provided with a sensor level/duration time table RAM14. Except for this addition, the structure of the fire control panel RE' is the same as that of the fire control panel RE shown in FIG. 1, repeated description of which will accordingly be unnecessary.

Further, in the fire detector $DE_1'$, the temperature sensor portion $FS_2$, the gas sensor portion $FS_3$ and the interfaces IF22 and IF23 of the fire detector $DE_1$ shown in FIG. 1 are deleted and instead an environmental information detecting interface IF25 is provided for receiving signals indicative of the operating state of the air conditioner $AC_1$. Except for this difference, the structure of the fire detector $DE_1'$ is same as that of the fire detector shown in FIG. 1. Accordingly, repeated description will be omitted here.

The information concerning ventilation fetched from the air conditioner $AC_1$ through the interface IF25 is sent out onto the transmission line L through the interface IF24 and the signal transceiver portion TRX2 together with the detection output (physical quantity of smoke) of the fire phenomenon detecting means $FS_1$ fetched through the interface IF21 in response to the polling call from the fire control panel RE'.

Before a concrete description of the operation of the second embodiment of the present invention by reference to FIG. 5A, FIG. 5B, FIG. 6 and FIG. 7, the concept or principle underlying the second embodiment will first be described.

The second embodiment is so arranged as to receive at the inputs thereof three types of information, i.e. the sensor levels of smoke sensors, duration time for which the sensor level continues to be equal to or higher than a predetermined value and the operating state of the air conditioner as the environmental information and to execute rapidly and correctly the various decisions concerning a fire such as fire probability and danger level on the basis of the input information. The operation of the second embodiment will first be described with the aid of FIG. 2A and FIG. 3A.

FIG. 2A shows a table containing two real or highly accurate fire decision values, i.e. fire probability and the degree or level of danger for fourteen combinations or patterns of the three types of input information mentioned above. The table can be prepared accurately through experiments or like empirical methods in consideration of the characteristics of fire detectors, the places where they are installed and other factors. In this conjunction, it is practically impossible to prepare this kind of table experimentally or empirically for all the different patterns (e.g. 14 patterns) of the three types of information. However, according to the teaching of the present invention elucidated below, it is possible to determine accurately the fire decision values for all the patterns of the three types of input information mentioned above.

Referring to FIG. 2A, there are listed in the leftmost three columns the sensor levels $IN_1'$ of the individual smoke sensors, the time $IN_2'$ during which the sensor level continues to be equal to or higher than a predetermined value and the on- or off-state $IN_3'$ of the ventilation at the time point the sensor level is detected, respectively, while shown in the rightmost two columns are the fire probability $T_1$ and the degree of danger $T_2'$ in terms of values in the range from 0 to 1, respectively, in correspondence with the three types of information contained in the three left columns. Similarly, the information in the three left columns are converted into values each in the range of 0 to 1. In this case, the value of 0 to 1 of the smoke sensor portion corresponds to a smoke concentration of 0 to 20%/m detected by the smoke sensor, the value of 0 to 1 of the duration time corresponds to 0 to 100 seconds, and the value of 0 or 1 indicating the on- or off-state of ventilation represents whether the air conditioning equipment is operating or not at the time point when the sensor level is detected.

Although the third type of information is assumed to represent only the on- or off-state of ventilation for convenience of description, it is preferred to use the information concerning the number of times of ventilation per hour to thereby realize finer control in practical applications. In that case, the value of 0 to 1 for the third type of information concerning the ventilation may be made to correspond to, for example, 0 to 3 cycles of ventilations per hour.

Figure 3A:
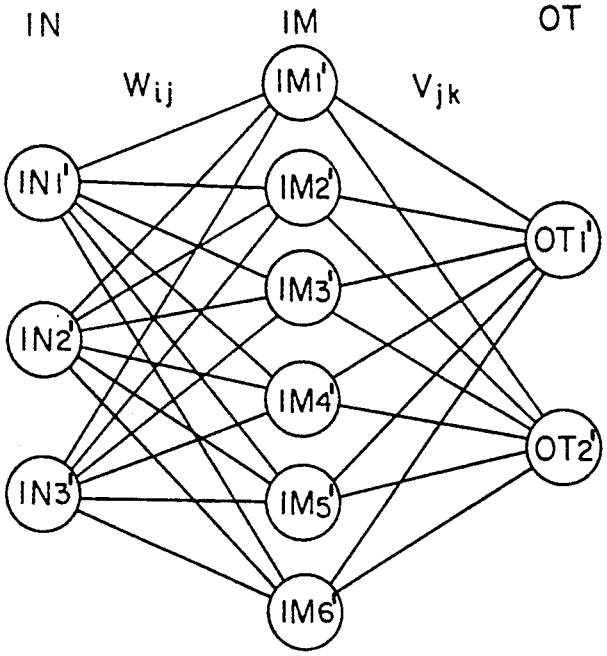

For elucidation of the operation of the second embodiment, it will be assumed that the net structure is as shown in FIG. 3A, is similar to that shown in FIG. 3. In the net structure shown in FIG. 3A, the three input layers $IN_1'$, $IN_2'$ and $IN_3'$ on the left side of the net structure are supplied with the signals from the smoke sensor portion FS converted to values in the range of 0 to 1, the duration times converted to values in the range of 0 to 1 and the ventilation on-or off-state signals represented by 0 or 1, respectively. On the other hand, output from the output layers $OT_2$ and $OT_2'$ seen on the right side are the fire probability and the degree of danger represented by the values of 0 to 1, respectively.

As the intermediate layers, there are shown six layers $IM_1'$ to $IM_6'$, by way of example only. Consequently, eighteen signal lines extend from the input layers to the intermediate layers, while twelve signal lines extend from the intermediate layers to the output layers, as can be seen in FIG. 3A.

When the weight value imparted to each of the eighteen signal lines extending between the input layers INi and the intermediate layers IMj is represented by Wij while representing by Vjk the weight value assigned to each of the twelve signal lines extending between the intermediate layers IMj and the output layers OTk (where $i=1\sim I\ [=3]$, $i=1\sim J\ [=6]$, and $k=1\sim K\ [=2]$), as in the case of the first embodiment, the relations between the input values $IN_1'$, $IN_2'$ and $IN_3'$ and the output values $OT_1'$ and $OT_2'$ can be given by Eq. 1 to Eq. 4 described hereinbefore in conjunction with the first embodiment. Thus, the weight values Wij and Vjk can be determined with the aid of the net generating program illustrated in FIG. 6 depending on the input-/output relations between the input layers and the output layers in accordance with Eq. 1 to Eq. 6 mentioned hereinbefore and stored in the weight value storage area RAM13 shown in FIG. 1A at the area assigned to the relevant fire detector.

FIG. 8A shows examples of measured values of the fire probability and the degree or level of danger for the sensor levels of the smoke sensor portions, the duration time and the on/off states of the air conditioning operation, as obtained after the adjustment procedure through the steps 603 to 613 shown in FIG. 6 has been repeated 407 times. The pattern identification numbers coincide with those of the definition table shown in FIG. 2A, wherein the data IN on the topmost row in each of the fields labeled with the pattern numbers correspond to the values of the sensor level $IN_1'$ of the smoke sensor portion, the duration time $IN_2'$ and the on/off value $IN_3'$ of the air conditioning operation shown in FIG. 2A, the data T on the mid row correspond to the values of the fire probability $T_1'$ and the degree of danger $T_2'$ to be utilized as the teacher signal output shown in FIG. 2A, and the data OT on the bottom row correspond to the actually measured values $OT_1'$ and $OT_2'$ of the fire probability and the degree of danger, respectively. Further, at the topmost row of FIG. 8A, there is shown the numerical values for the calculation according to Eq. 6. The weight values used in obtaining the actually measured values shown in FIG. 8A are shown in FIG. 9A.

Figure 10A:
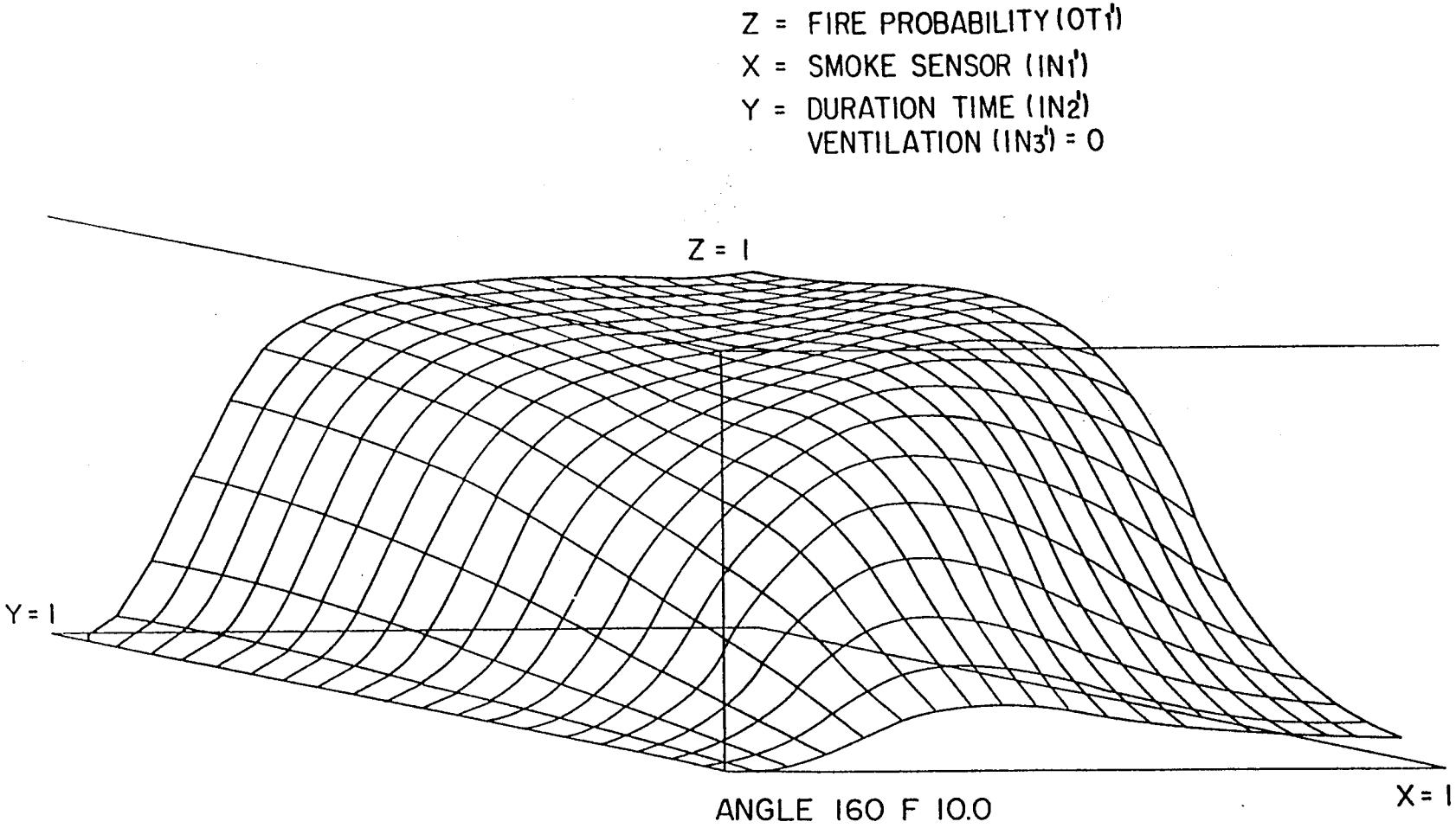
FIG. 10A and FIG. 11A are views showing the output values of the signal processing net according to the second embodiment, in which the probability of a fire $OT_1$ and degree of danger $OT_2$ are shown along the Z-axis for the smoke sensor level $IN_1$ (X-axis) and the duration time $IN_2$ (Y-axis) on the assumption that ventilation is off ($IN_3=0$).
Figure 11A:
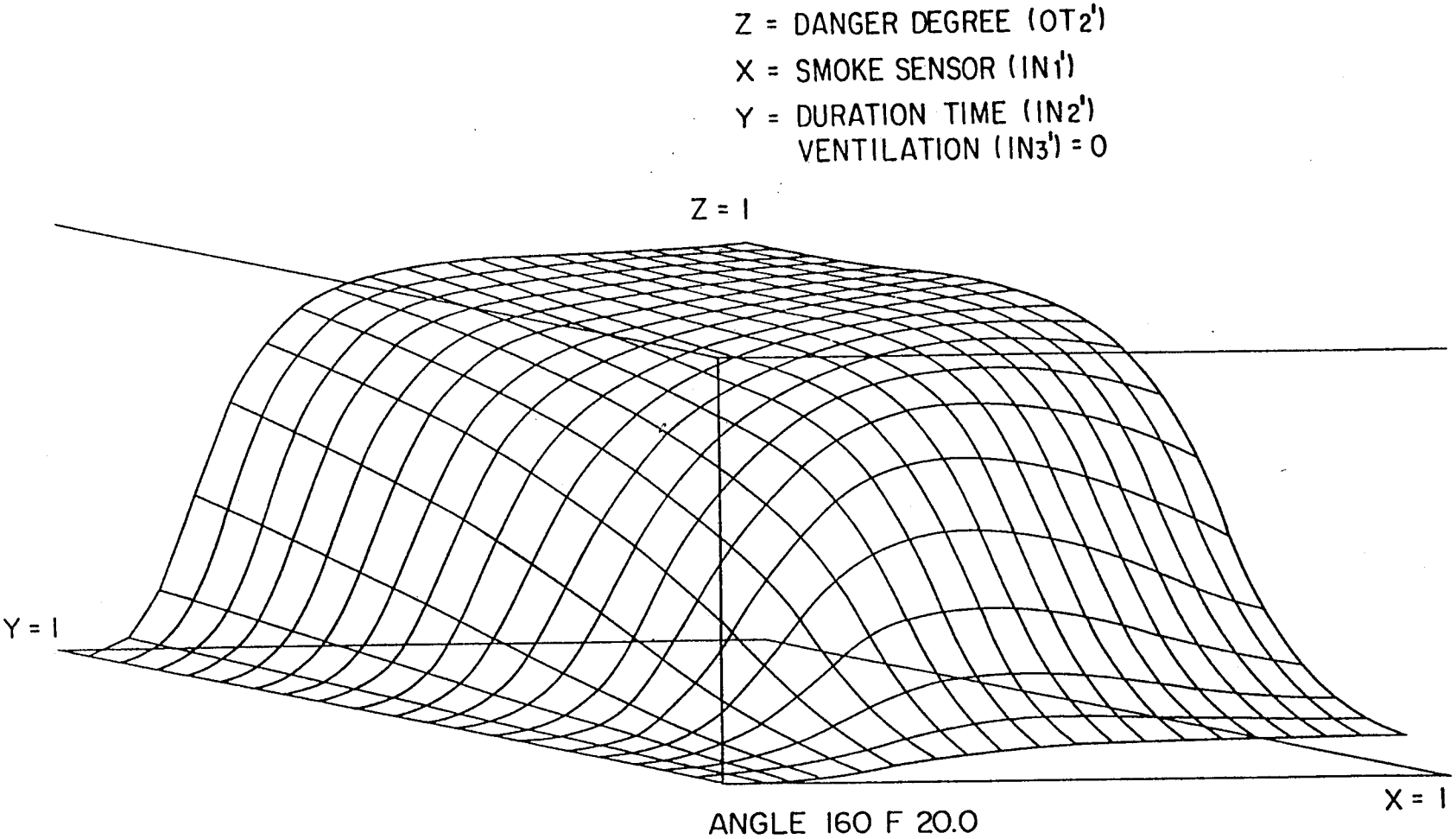
Figure 12A:
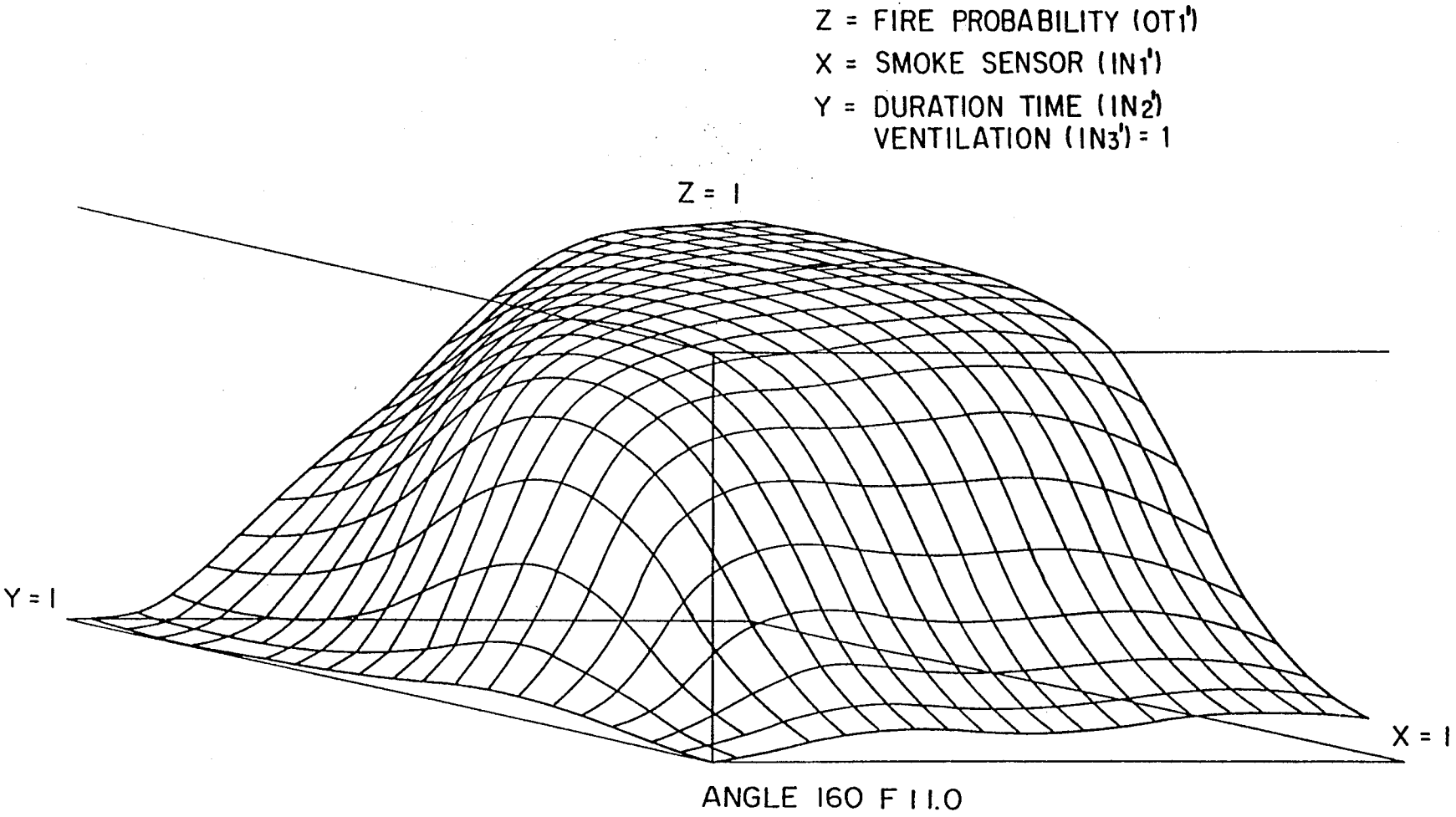
FIG. 12A and FIG. 13 are views showing the output values of the signal processing net in the second embodiment, in which the probability of a fire $OT_1$ and the degree of danger $OT_2$ are shown along the Z-axis for the smoke sensor level $IN_1$ (X-axis) and the duration time $IN_2$ (Y-axis) on the assumption that ventilation is on ($IN_3=1$).

FIG. 10A and FIG. 11A are views showing the fire probability $OT_1'$ and the degree of danger $OT_2$, respectively, which are taken along the Z-axis with the smoke sensor output and the duration time being taken along the X-axis and the Y-axis, respectively, in the case where the air conditioning operation is not being effected or is off. Similarly, FIG. 12A and FIG. 13 show the fire probability $OT_1'$ and the degree of danger $T_2'$, respectively, taken along the Z-axis with the smoke sensor output and the duration time being taken along the X-asis and the Y-axis, respectively, for the case in which the air conditioning operation takes place.

By defining the fire probability and the degree of danger for the combinations of the three input information values in the form of the fourteen patterns, it is possible to produce optimum output or answer by virtue of interpolation by the net structure for those combinations of the input information which are absent in the definition table. In the case of the second embodiment, it is shown that the number of the inputs to the net structure is three and that of the outputs is two. As the inputs, there can be used in addition to combinations of the sensor levels, the detection levels of the smoke sensors information and the number of times of ventilation or the operating state of the air conditioning equipment as the environmental information, other various combinations of the sensor outputs of the smoke sensors, heat sensors, gas sensors and others with the size and types of rooms, on/off-states of lighting, the types and amounts of combustibles, humidity, and if there are comings and goings of unspecified numbers of people, etc., as occasion requires. Further, for the outputs, various combinations of the probability of being no fire, visible distance, walking speed, the probability of fire extinguishment and others may be used.

Upon completion of the teaching of the table shown in FIG. 2A to the net structure shown conceptually in FIG. 3A, i.e. upon completion of adjustment of the weight values allocated to the signal lines on a line-by-line basis (N of the step 408 shown in FIG. 4), the input values of the sensor level, the duration time and the on/off state of ventilation as the environmental information are supplied to the net structure in accordance with the net calculation program shown in FIG. 7 for the actual fire monitoring, to thereby determine the values obtained from the individual output layers through calculation in accordance with Eq.1 to Eq.4 mentioned hereinbefore, whereon the values resulting from the calculation are compared with the reference values of the fire probability and the degree of danger to thereby make a decision concerning the fire.

More specifically, referring to FIG. 4, FIG. 5A, FIG. 5B and FIG. 7, the fire monitoring operation is performed sequentially through the steps 409 et seq. shown in FIG. 4, starting from the first fire detector. Describing the fire monitoring operation in connection with the n-th fire detector DEn', a data send-back command for the n-th fire detector DEn' is sent onto the signal line L from the signal transceiver TRX1 through the interface IF11 (step 411).

Upon reception of the data send-back command by the n-th fire detector DEn', this fire detector fetches the sensor level attributable to the smoke as detected by the smoke sensor portion $FS_1$ as the physical quantity concerning the fire phenomenon and the operating state of the associated air conditioning equipment ACm (m=1~M), i.e. the on/off state of the ventilation through the environmental information detecting interface IF25 to thereby send out en bloc the fetched information in accordance with the program stored in the program storage area ROM21.

The data sent from the n-th fire detector DEn', if any, (Y of step 412), i.e. the sensor levels and the ventilation on/off information are stored in the work area RAM11 (step 413).

For determining the duration time, the work area RAM11 is allocated with areas for storing a plurality of sensor levels for each of the fire detectors, wherein the sensor levels sent back from the individual fire detectors upon every polling are saved, for example, for five minutes with the oldest data being discarded.

The latest sensor level just sent from the n-th fire detector DEn' is compared with a predetermined level A. If it is equal to or higher than the predetermined level A (Y of a step 514 in FIG. 5A), operation is then performed on the basis of the sensor level stored in the work area RAM11 to update the sensor level/duration time table for the n-th fire detector DEn' which is stored in the storage area RAM14 (step 515).

FIG. 5B shows conceptually the sensor level/duration table prepared in the areas of the storage area RAM14 allocated to the individual fire detectors, respectively, in which table the sensor levels detected by the smoke sensor portion $FS_1$ and converted to the digital quantities are listed in the left column. The sensor level is in proportion to the value of the smoke concentration. More specifically, when the sensor level of "10" equal to the predetermined level A is equal to a smoke concentration of 2.5%/m, by way of example, the sensor level of "50" is then equal to a smoke concentration of 12.5%/m. Accordingly, a smoke concentration of 20%/m corresponds to a sensor level of "80", which corresponds to the converted value of "1.0" shown in the definition table mentioned hereinbefore.

Written in the right column of the table shown in FIG. 5B are the duration time in case sensor levels equal to or higher than those listed in the left column are input. More specifically, the duration time written in the right column for the sensor level of "10" in the left column continues to be counted up so long as the sensor levels fetched upon every polling are not lower than the predetermined level A, i.e. the sensor level of "10", and is cleared to "0" when the sensor level as fetched becomes lower than "10". Similarly, the duration time in the right column at the sensor level of "11" in the left column continues to be counted up so long as the sensor level fetched at every polling is not lower than the sensor level of "11" and is cleared to zero when the fetched sensor level becomes lower than "11". In a similar manner, the duration times in the right column are counted up or cleared until a sensor level of "50" of the left column is attained.

When the content of the sensor level/duration time table stored in the area of the storage area RAM14 allocated to the n-th fire detector DEn' has been updated on the basis of the data written in the work area RAM11, then the net structure calculation program 700 shown in FIG. 7 as well is executed on the basis of the data stored in the storage area RAM14 and additionally the ventilation on/off information placed in the work area RAM11. For execution of the net structure calculation program 700, the individual sensor levels and the duration times as well as the ventilation on/off information is converted to the value INi of 0 to 1 (i=1~I [I=3]). According to the second embodiment, the converted value $IN_1$ resulting from the conversion of the sensor level, the converted value $IN_2'$ of the duration time and the converted value $IN_3'$ of the ventilation on/off information are made use of.

When the values of INi are determined, the net structure calculation program (step 700) is executed for all the duration times or periods not yet cleared. Namely, in the case of FIG. 5B, the duration time corresponding to the sensor level of "15" is cleared. Accordingly, the net structure calculation program is executed for five sensor levels of "10" to "14".

At first, the net structure calculation program 700 shown in FIG. 7 is executed by using as $IN_1'$ the converted value of 0~1 of the sensor level of "10" in the left column of FIG. 5B, while using the converted value of 0~1 of the duration time in the right column corresponding to the sensor level of "10" as $IN_2'$ and the converted value of 0 or 1 of the ventilation on/off information placed in the work area RAM11 as $IN_3'$, respectively. More specifically, $NET_1(j)$ is calculated in accordance with the expression Eq.1 (step 703), the result of the calculation being then converted to the value of IMj in accordance with the expression Eq.2 (step 704). When the values of IMj for all of $IM_1'$ to $IM_6'$ have been determined (Y of a step 705), then $NET_2(k)$ is calculated by using the values of IMj in accordance with the expression Eq.3 (step 708), the results being converted to the values of OTk in accordance with the expression Eq.4 (step 709). When the values of OTk for all of $OT_1'$ to $OT_2'$ have been determined (Y of a step 710), then the processing returns to the flow chart shown in FIG. 5A. The values of $OT_1'$ and $OT_2'$ thus determined represent the actually measured values of the fire probability F and the degree of danger D, respectively.

The fire probability F and the degree of danger D are compared with the respective initial values $F_o$ and $D_o$ (steps 517 and 519), whereby the larger values are retained as the fire probability $F_o$ and the degree of danger $D_o$ (step 518 and 520).

When the fire probability and the degree of danger have been determined on the basis of a sensor level of "10" in the left column and the corresponding duration time in this way, the step 516 is regained, whereon the net structure calculation program 700 is executed similarly on the basis of a sensor level of "11" of the left column used as $IN_1'$ and a duration time corresponding to the sensor level of "11" used as $IN_2'$, to thereby determine the fire probability F and the degree of danger D which are then compared with $F_o$ and $D_o$ determined previously, respectively, and the data of larger values are retained. A similar procedure is repeated up to a sensor level of "14" in the left column, whereby the fire probability and the degree of danger the greatest values are finally obtained.

When it is decided that the processing for all the contents of the sensor level/duration time table stored in the storage area RAM14 for the n-th fire detector has been completed (Y of step 516) and when the fire probability $F_o$ and the degree of danger $D_o$ of the maximum values have finally been determined, the fire probability $F_o$ thus determined is compared with the reference value B of the fire probability read out from the various constants table storage area ROM12. When $F_o \geqq B$ (Y of step 521), a fire indication is generated (step 522) with the degree of danger $D_o$ being indicated as it is, to warn of a danger state (step 523).

Through the procedure described so far, the fire monitoring operation for the n-th fire detector comes to an end, and a similar fire monitoring operation is repeated for the next fire detector.

Step 514 is regained, and when it is decided that the sensor level stored in the work area RAM11 as the result of polling is lower than the predetermined level A (N of the step 514), then the n-th fire detector area of the sensor level/duration time table storing area RAM14 is cleared (step 525), whereon the processing is turned to the fire monitoring operation for the next fire detector.

Although it has been described in conjunction with the above embodiment that the data are artificially input to the definition table storage area RAM12 to thereby allow the weight values to be stored in the storage area RAM13 on the basis of the input data through the net structure generating program, it is equally possible to determine the weight values by using the net structure generating program at a manufacturing stage in a factory and store the weight values in a ROM such as an EPROM or the like, the ROM then being incorporated in the system.

In addition to the analog type fire alarm system described above in conjunction with the exemplary embodiments, the present invention is also applicable to an on/off type fire alarm system in which decisions concerning a fire are performed on the side of individual fire detectors, wherein only the result of decision is supplied to the receiving means such as the fire control panel, repeater or the like. In that case, the ROM11, ROM12 and RAM14 shown as incorporated in the fire receiver in FIG. 1 or FIG. 1A are disposed in each of the fire detectors. Further, it is preferred that a ROM loaded with the weight values at a manufacturing stage in a factory as mentioned above is incorporated in each of the fire detectors in place of the RAM12 and RAM13 in consideration of the fact that no space is available in the fire detector for providing ten keys, etc. shown in FIG. 1 or FIG. 1A for inputting the data in the RAM12.

I claim:

1. A fire alarm system for monitoring the presence of a fire based on K fire related probabilities derived from the detection of I different fire related phenomena, where K and I are integers and I has a value of at least 2, comprising:

sensor means for detecting said I different fire related phenomena and for generating I sensor detection values respectively indicative of the thus detected said I different fire related phenomena;

a data table for storing in advance a plurality of combinations of I prestored detection values and a plurality of combinations of K prestored fire related probability values respectively associated with said plurality of combinations of I prestored detection values;

a signal processing means, having a net structure formed of a plurality of network layers, for receiving said I sensor detection values from said sensor means and for generating K output fire related probability values respectively indicative of said K fire related probabalities, said plurality of network layers having weight coefficients assigned thereto, said signal processing means processing said I sensor detection values with said weight coefficients to obtain corresponding weighted detection values and processing said weighted detection values to obtain corresponding weighted intermediate detection values and processing said weighted intermediate detection values to obtain each of said K output fire related probability values;

weight coefficient adjustment means for applying the plurality of combinations of I prestored detection values to said net structure of said signal processing means to arithmetically determine values of said weight coefficients to obtain corresponding K probability values output by said net structure for each applied combination of I prestored detection values which coincide with the associated combination of said K prestored fire related probability values stored in said data table.

2. A fire alarm system for monitoring the presence of a fire based on K fire related probabilities derived from the detection of I different fire related phenomena, where I and K are integers and I has a value of at least 2, comprising:

sensor means for detecting said I different fire related phenomena and for generating I sensor detection values respectively indicative of the thus detected said I different fire related phenomena;

a signal processing means, having a net structure formed of a plurality of network layers, for receiving said I sensor detection values from said sensor means and for generating K output fire related probability values respectively indicative of said K fire related probabilities, said plurality of network layers having weight coefficients assigned thereto, said signal processing means processing said I sensor detection values with said weight coefficients to obtain corresponding weighted detection values and processing said weighted detection values to obtain corresponding weighted intermediate detection values and processing said weighted intermediate detection values to obtain each of said K output fire related probability values;

means for previously storing values of said weight coefficients determined by comparing a set of said K output fire related probability values obtained by applying a given set of I input sensor detection values to said signal processing means with a set of K target fire related probability values which are previously determined to be associated with said given set of I input sensor detection values, said weight coefficients are determined to minimize a difference between said set of said K output fire related probability values and said set of K target fire related probability values;

wherein the thus stored values of said weight coefficients are said weight coefficients assigned to said plurality of network layers of said net structure.

3. A fire alarm system as recited in claim 1 or 2, said plurality of network layers of said net structure including I input network layers, J intermediate network layers and K output network layers each having said weight coefficients assigned thereto, each of said I input network layers receiving a corresponding one of said I sensor detection values to obtain said corresponding weighted detection values and outputting J weighted detection values using the weight coefficients assigned thereto, each of said J intermediate network layers receiving a corresponding one of said J weighted detection values output from each of the I input network layers, summing thus received I corresponding weighted detection values respectively output from said I input network layers to obtain said intermediate detection value, and outputting K weighted intermediate detection values by applying the weight coefficients assigned thereto to said intermediate detection value, and each of said K output network layers receiving a corresponding one of said K weighted intermediate detection values output from each of said J intermediate network layers and summing thus received J corresponding intermediate detection values respectively output from said J intermediate network layers to obtain and output a corresponding one of said K fire related probability values.

4. A fire alarm system as recited in claim 1 or 2, wherein said I different fire related phenomena include at least two of a smoke density, a gas concentration and temperature.

5. A fire alarm system as recited in claim 1 or 2, wherein said I different fire related phenomena include at least two of a smoke density, a gas concentration and temperature, and an environmental condition of a detected area.

6. A fire alarm system as recited in claim 2, further including a fire receiver and a plurality of fire detectors connected to said fire receiver, said sensor means located at said plurality of fire detectors, and said signal processing means and said storing means located at said fire receiver.

7. A fire alarm system as recited in claim 2, further including a fire receiver and a plurality of fire detectors connected to said fire receiver, said sensor means and said signal processing means and storing means located at said plurality of fire detectors.

8. In a fire alarm system for monitoring the presence of a fire based on one fire related probability derived from the detection of I different fire related phenomena, where I is an integer having a value of at least 2, a fire monitoring method comprising:

(1) carrying out a learning process including the steps of (a) experimentally obtaining a plurality of combinations of I detection values and a plurality of probability values respectively associated with said plurality of combinations of I detection values, (b) temporarily assigning values to first weight coefficients applied to said plurality of combinations of I detection values, (c) applying the first weight coefficients assigned in step (b) to said I detection values of a first one of said plurality of combinations of I detection values and summing the thus weighted I detection values to obtain a first sum value for each of J intermediate detection values, (d) temporarily assigning values to second weight coefficients applied to said J intermediate detection values, (e) applying the second weight coefficients assigned in step (d) to said J intermediate detection values obtained by applying the first weight coefficients to said I detection values of said first one of said plurality of combinations of I detection values and summing the thus weighted J intermediate detection values to obtain a second sum value for a probability value, (f) comparing said second sum value with one of said probability values associated with said first one of said plurality of combinations of I detection values to obtain a compared value, (g) repeating said steps (c), (e) and (f) with respect to each of the remaining said plurality of combinations of I detection values in succession, and summing absolute values of a plurality of said compared values obtained in said step (f) to obtain an absolute sum, (h) continuously repeating said steps (b) through (g) by varying values of said first and said second weight coefficients until said values of said first and said second weight coefficients are obtained which minimize said absolute sum, and (i) storing said values of said first and said second weight coefficients obtained in said step (h) which minimize said absolute sum; and (2) carrying out a detection process including the steps of (a) sensing I fire related phenomena and generating corresponding I sensor detection values, (b) applying the first weight coefficients stored in said step (i) of said learning process to the I sensor detection values and summing the thus weighted I sensor detection values to obtain J intermediate sensor detection values, (c) applying the second weight coefficients stored in said step (i) of said learning process to said J intermediate sensor detection values and summing the thus weighted J intermediate sensor detection values to obtain one fire probability value, and (d) determining the probability of a fire based on the one fire probability value.

9. In a fire alarm system for monitoring the presence of a fire based on K fire related probabilities derived from the detection of I different fire related phenomena, where I and K are integers having a value of at least 2, a fire monitoring method comprising:

(1) carrying out a learning process including the steps of (a) experimentally obtaining a plurality of combinations of I detection values and a plurality of combinations of K probability values respectively associated with said plurality of combinations of I detection values, (b) temporarily assigning values to first weight coefficients applied to said plurality of combinations of I detection values, (c) applying the first weight coefficients assigned in step (b) to said I detection values of a first one of said plurality of combinations of I detection values and summing the thus weighted I detection values to obtain a first sum value for each of J intermediate detection values, (d) temporarily assigning values to second weight coefficients applied to said J intermediate detection values, (e) applying the second weight coefficients assigned in step (d) to said J intermediate detection values obtained by applying the first weight coefficients to said I detection values of said first one of said plurality of combinations of I detection values and summing the thus weighted J intermediate detection values to obtain a second sum value for each of K probability values, (f) comparing said K second sum values respectively with the K probability values of a one of said plurality of combinations of said K probability values associated with said first one of said plurality of combinations of I detection values to obtain a compared value for each of said K second sum values and summing absolute values of the thus obtained K compared values to obtain an absolute sum, (g) repeating said steps (c), (e) and (f) with respect to each of the remaining said plurality of combinations of I detection values in succession, and summing the absolute sums obtained in said step (f) to obtain a total absolute sum, (h) continuously repeating said steps (b) through (g) by varying values of said first and said second weight coefficients until said values of said first and said second weight coefficients are obtained which minimize said total absolute sum, and (i) storing said values of said first and second weight coefficients obtained in said step (h) which minimize said total absolute sum; and (2) carrying out a detection process including the steps of (a) sensing I fire related phenomena and generating corresponding I sensor detection values, (b) applying the first weight coefficients stored in said step (i) of said learning process to the I sensor detection values and summing the thus weighted I sensor detection values to obtain J intermediate sensor detection values, (c) applying the second weight coefficients stored in said step (i) of said learning process to said J intermediate sensor detection values and summing the thus weighted J intermediate sensor detection values to obtain said K fire probabilities, and (d) determining the probability of a fire based on said K fire probabilities.

10. A fire monitoring method as recited in claim 9, wherein said learning process is carried out as part of an initialization of said fire alarm system after said fire alarm system has been installed at an operating location.

11. A fire monitoring method as recited in claim 9, wherein said learning process is carried during the course of manufacturing said fire alarm system.

* * * * *